United States Patent [19]

Snyder

[11] Patent Number: 4,494,617

[45] Date of Patent: Jan. 22, 1985

[54] SHAFT BORING MACHINE

[75] Inventor: Larry L. Snyder, Golden, Colo.

[73] Assignee: Harrison Western Corporation, Golden, Colo.

[21] Appl. No.: 461,675

[22] Filed: Jan. 27, 1983

[51] Int. Cl.[3] ..... E21C 1/00; E21B 3/00

[52] U.S. Cl. ..... 175/86; 175/88; 175/94; 175/99; 175/322; 299/31; 299/58; 299/67

[58] Field of Search ..... 175/86, 88, 94, 95, 175/97, 98, 99, 104, 122, 219, 322, 343; 299/18, 31, 45, 56, 58, 67

[56] References Cited

U.S. PATENT DOCUMENTS

| | | | |
|---|---|---|---|
| 3,379,264 | 4/1968 | Cox | 175/99 |
| 3,383,138 | 5/1968 | Scaravilli et al. | 175/94 |
| 3,965,995 | 6/1976 | Susden | 175/86 |
| 4,122,683 | 10/1978 | Follert et al. | 299/31 |
| 4,189,186 | 2/1980 | Snyder | 299/31 |
| 4,396,072 | 8/1983 | Hurtz et al. | 299/31 |

FOREIGN PATENT DOCUMENTS

| | | | |
|---|---|---|---|
| 732491 | 4/1966 | Canada | 299/31 |
| 48002 | 2/1980 | Fed. Rep. of Germany | 299/31 |
| 48007 | 7/1980 | Fed. Rep. of Germany | 299/31 |
| 799834 | of 1936 | France | 175/99 |

*Primary Examiner*—Stephen J. Novosad
*Assistant Examiner*—William P. Neuder
*Attorney, Agent, or Firm*—Klaas & Law

[57] ABSTRACT

A machine for boring a shaft in earth strata or the like. An annular support ring means having an outside diameter approximately equal to the diameter of the shaft which is selectively engageable or disengageable with the shaft wall by the use of clamping means is disclosed. A carriage means which is slidably mounted on the annular support ring means and orbital thereabout is also disclosed. A rotary cutting wheel means having a diameter substantially smaller than the diameter of the shaft is mounted on the carriage means and is axially displaceable with respect thereto for movement in a direction which may be parallel or inclined with respect to the axis of the shaft. Various drive means for moving the carriage means circumferentially about the annular support ring means, and for moving the rotary cutting wheel means in an axial direction with respect to the carriage means, and for rotating the rotary cutting wheel means are described. The use of the machine to make an overlapping helical path cut in earth strata whereby a generally cylindrical shaft is created is also described.

96 Claims, 16 Drawing Figures

SHAFT BORING MACHINE

BACKGROUND OF THE INVENTION

This invention relates to large size, shaft type, rock excavating machines and, more particularly, to down-the-hole type shaft excavating machines capable of forming, being suspended in and movable along a vertical shaft in a rock formation.

While large size boring machines have been heretofore successfully developed for cutting generally horizontally extending tunnels, at the present time there has been limited development of large size shaft boring machines for cutting generally vertically extending shafts. Although tunnel boring machines and shaft boring machines involve some common requirements and problems, such as the capability of excavating various types and quality of rock strata at the bore site, they have even more non-common requirements and problems. Thus, tunnel boring technology has not heretofore provided a satisfactory solution to mechanized shaft sinking problems.

Shaft sinking is one of the most time consuming, costly and hazardous operations in opening a new mine or providing additional access to an expanding mine. With few exceptions, shafts sunk today are excavated by drilling and blasting—a method which has been the practice for over a hundred years. The prior art has included a mechanical lashing device which enables the muck to be removed as fast as powerful hoisting systems can handle it. Such operations are heavily labor intensive, requiring as many as 60 laborers on the shaft bottom during the drilling cycle. The method has since improved with delay detonators, hydraulic drill jumbos, and improved mechanical mucking machines, but it is still labor intensive and at times, provides such poor working conditions due to noise, heat, dirt and fumes, that it is becoming increasingly difficult to find miners willing to work in the shafts.

Because some existing tunnel boring machines can bore at rates of over 200 feet per day, and because of the similarity of shaft and tunnel construction, the application of tunnel boring technology to shaft sinking has been given previous consideration. Many of the shaft sinking devices borrowing from tunnel boring technology, require a pilot hole for the cuttings to fall through for muck removal.

It can be seen that a substantial effort has been devoted to the mechanization of shaft sinking in the last two decades. Competition due to mining of more favorable mineral deposits, scarcity of experienced personnel, decreasing willingness of personnel to do physical work, and larger and deeper shafts have caused machinery manufacturers and contractors alike to attempt to make improvements in mechanization of shaft sinking. The past trend in mechanization of shaft sinking has been to larger and larger drills.

The need for improvements in shaft excavation technology has been expounded in nearly every mining related journal or technical meeting over the last several years. Millions of dollars are being spent annually by industry and government alike to advance the state of the art. This recent interest stems from several activities. They are: coal mining, metal mining, oil mining, military and defense, pumped storage and nuclear waste isolation.

Recent estimates of shaft demand for coal mining in the U.S. are that 340 to 470 shafts greater than 1000 ft.

will be excavated between 1980 and 1990. Although the present world economy has slowed many mining projects, if not deferred them indefinitely, other related underground projects have begun to gather momentum. Nuclear waste isolation, pumped storage and military programs are a few of these upcoming projects.

There are a variety of shaft excavation methods including drilled shafts, bored shafts, conventional shafts, raised shafts, round shafts, elliptical shafts, square shafts, and inclined shafts. This invention relates particularly to down-the-hole blind shaft boring machines, although it is equally adapted to non-blind shafts with a pilot-hole as well.

Prior art blind shaft boring machines have all been unsatisfactory with respect to the major problem of removal of cuttings, which is referred to as mucking. It is necessary that any machine be capable of lifting the cuttings reliably from the shaft bottom to a point above the machine.

Successful usage of prior art shaft boring machines has required a pre-drilled pilot hole for muck removal at a substantial increase in cost and time of the sinking operation. Prior art attempts to develop a successful down-the-hole shaft boring machine have been based on the common concept that tunnel boring machines could be stood upright to sink shafts. The basic problems associated with using tunnel boring machine designs for shaft boring machines are as follows:

Full Face Cutting—most prior art shaft boring machines have used full face cutter wheels to excavate the shaft bottom whereby the diameter of the cutter wheel is substantially the same as the diameter of the shaft. A full face cutter wheel severly restricts the machines' mucking ability since all cut material must be directed to a singular or possibly multiple pickup point(s) in the cutter wheel. Questions relating to safety are also raised when one considers changing cutters on a full face shaft boring machine, since workmen must be below the machine during installation. Even with the advent of rear or side mounted cutters, the cutter wheel must be blocked off the shaft bottom to take the loads off the cutters. If a pilot hole exists in the shaft, care must be taken to prevent workers or cutters from falling down the hole during repairs or changes.

In blind shafts, water control is also a problem. Shafts are similar to large water wells and unless water pumps can be set at shaft bottom, the water will seriously affect the muck gathering ability of the cutter wheel and greatly reduce cutter life. Water control is a very important activity in shaft sinking. Unless suitable means are provided for water control, the blind shaft boring machine is in constant danger of being flooded.

Massive Structure—A massive structure is necessary to transmit the thrust and torque required to efficiently cut a full face of rock. This structure severly restricts the space available for the placement of a suitably sized mucking system through the machine. This structure also restricts access to the shaft bottom for water control, grout drilling, and/or probe drilling.

Gripper Pads—tunnel boring machines use gripper pads to grip the side of the tunnel and react to the machines' thrust and torque. When shaft boring machines use gripper pads, problems are encountered because the pad pressure required is too high. Shaft sinking, by its nature, traverses many geological formations with crushed rock and shear zones probable at each formation boundary. Pad pressures for shaft boring machines should be considerably lower than for tunnel boring machines so the machine may be secured in very weak rock.

Size, Weight and Cost—The application of tunnel boring machine technology to shaft sinking has resulted in shaft boring machines with tunnel boring machine specifications and rate of penetration capabilities. Conventional shaft sinking rates are typically 3 to 6 meters per day. Tunnel boring machines have been designed with the power to advance 30 to 60 meters a day but cannot be utilized at such high rates for shaft sinking because muck handling, hoisting and lining systems cannot keep up with such a high rate of advance. The high capital costs associated with the tunnel style machines are also a problem since the contractor-owner must amortize the machine cost over a shaft excavation length which is typically 1/10 to 1/20 the length of machine bored tunnels. Any shaft boring machine must be removed from the bottom of the shaft at the completion of the shaft sinking operation. Because of hoisting limitations from shaft depths, heavy machine components are undesirable. Thus, the machine must be manufactured with smaller, lighter pieces which are bolted together. This increases the cost of the machinery above conventional tunnel boring machine price levels.

Thus, a general object of the present invention is to provide a shaft boring machine which is functionally effective, suitable for the environment it must work in, lightweight and low in price.

SUMMARY OF THE INVENTION

Unlike prior art shaft boring machines which used full face cutter wheels, the present invention employes a cutter wheel which cuts only part of the shaft bottom at a time thus allowing access to the shaft bottom at any time. The present invention provides several advantages: (1) the shaft bottom is open for grouting and/or probe drilling; (2) water pumps may be set on shaft bottom; (3) cutters can be changed without maintenance personnel being underneath the machine; (4) muck pickup is easier, the cutter wheel loads the cut material directly onto a belt conveyor to be transported into the shaft muck haulage system; (5) the machine is about 40% of the weight and cost of a full face machine; (6) the machine can be used on blind shafts or shafts with boreholes; and (7) the machine can advance at 10 to 15 meters per day.

In the presently preferred embodiment of the invention, the bottom of the shaft is excavated by a rotating cutter wheel which is slightly greater than one-half the diameter of the excavated shaft. Sixteen inch diameter single disc cutters are mounted on the rim of the cutter wheel. The axis of the cutter wheel is located at the mid-radius of the shaft. The drive shaft is tilted 15° from the vertical in the direction of travel around the shaft. The cutter wheel is engaged its full rim depth into the shaft bottom. As the cutter wheel rotates about its own axis, it orbits around the center of the shaft thereby cutting the entire shaft bottom. While the cutter wheel orbits the shaft, it is simultaneously urged downwardly so the shaft bottom is advanced in the form of a downward helix. The construction and arrangement is such that the cutterhead is cutting a helix path of uniform width and pitch which overlaps a previously cut portion of the path.

The cutter wheel, cutter wheel drive apparatus, and cutterhead support structure are mounted on a carriage which is supported on, and propelled around, a support ring that is expanded against the shaft wall to anchor the machine in place. When the cutter wheel has traversed once around the shaft, the cutter wheel is stopped so the support ring may be advanced down the shaft. Support legs are downwardly extended from the support ring into engagement with the shaft face to prevent the support ring from falling when it is unclamped. The support ring is then released and lowered one pitch of the helix down the shaft. While the support ring is unclamped and resting on the support cylinders, steering corrections can be made by individually actuating power cylinders, associated with the support legs, thereby tilting the machine into the desired direction.

When the steering corrections have been completed, the support ring is again expanded to anchor the machine to the shaft wall. The support legs are then retracted and cutter wheel rotation is started. Carriage drive cylinders are then pressurized to push the carriage (with cutter wheel and cutter wheel drive) around the clamp ring, thereby starting a new cycle.

Radial paddles on the rim of the cutter wheel push the cuttings, which fall to the floor, around and up on an inclined muck ramp and onto a belt conveyor. A belt conveyor lifts the cuttings into a hopper which feeds the shaft haulage system. The shaft haulage system may be muck buckets, skips, pneumatic hoisting, hydraulic hoisting, or a vertical belt conveyor as determined by economics and final purpose of the shaft. The cutter wheel may also direct the cuttings down a pilot borehole if access to the shaft bottom is available before drilling operations commence.

In a common application such as the excavation of a 26 ft. finished diameter shaft in 14,000 psi rock, a machine having a total weight of approximately 280 tons and developing approximately 700 total horsepower would be a typical design choice.

BRIEF DESCRIPTION OF DRAWINGS

A presently preferred and illustrative embodiment of the invention is shown in the accompanying drawings in which.

DETAILED DESCRIPTION

Figure 1:
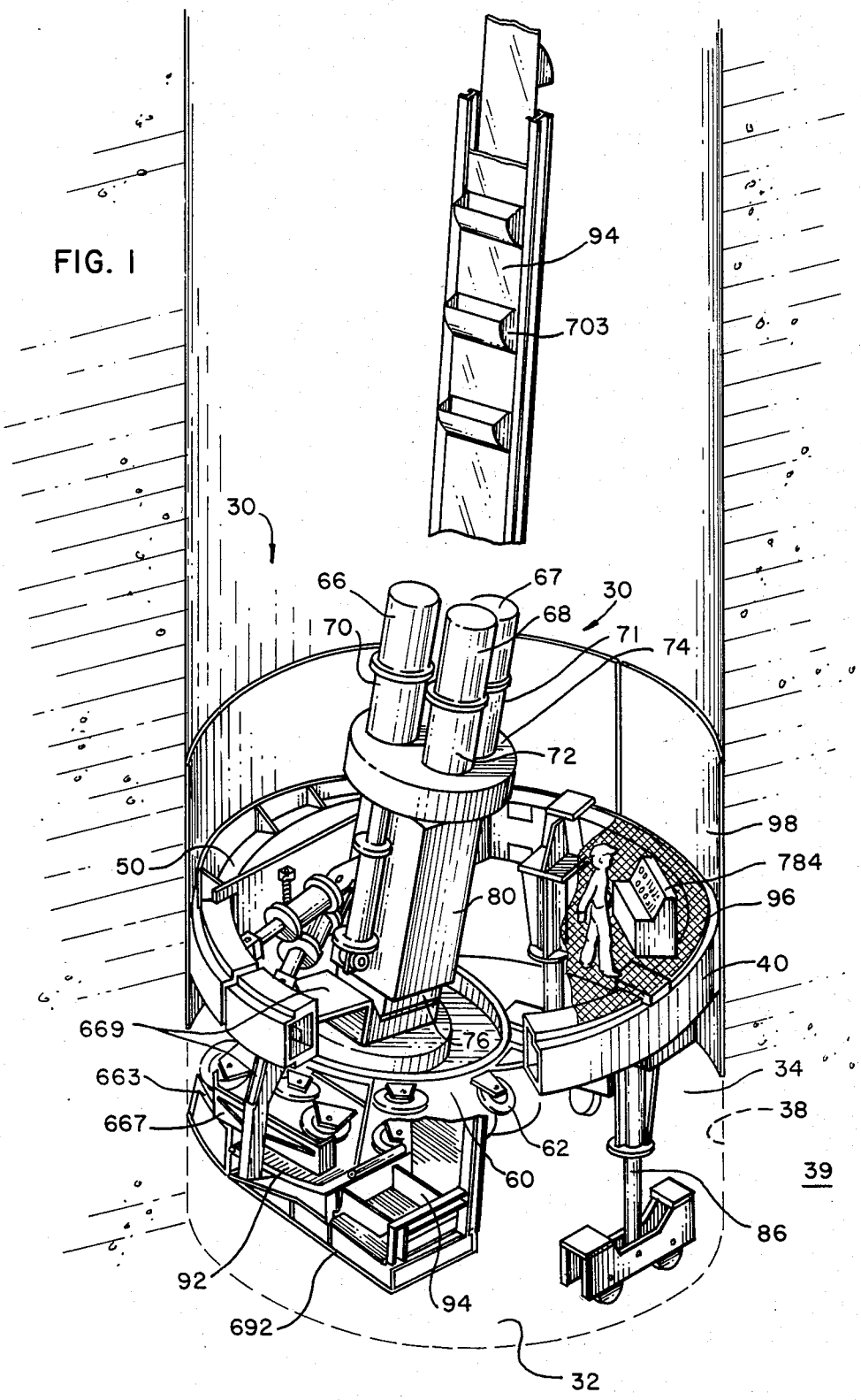
FIG. 1 is a perspective view of a shaft boring machine showing it positioned in a shaft which is illustrated in a cut-away perspective cross-section.
Figure 2:
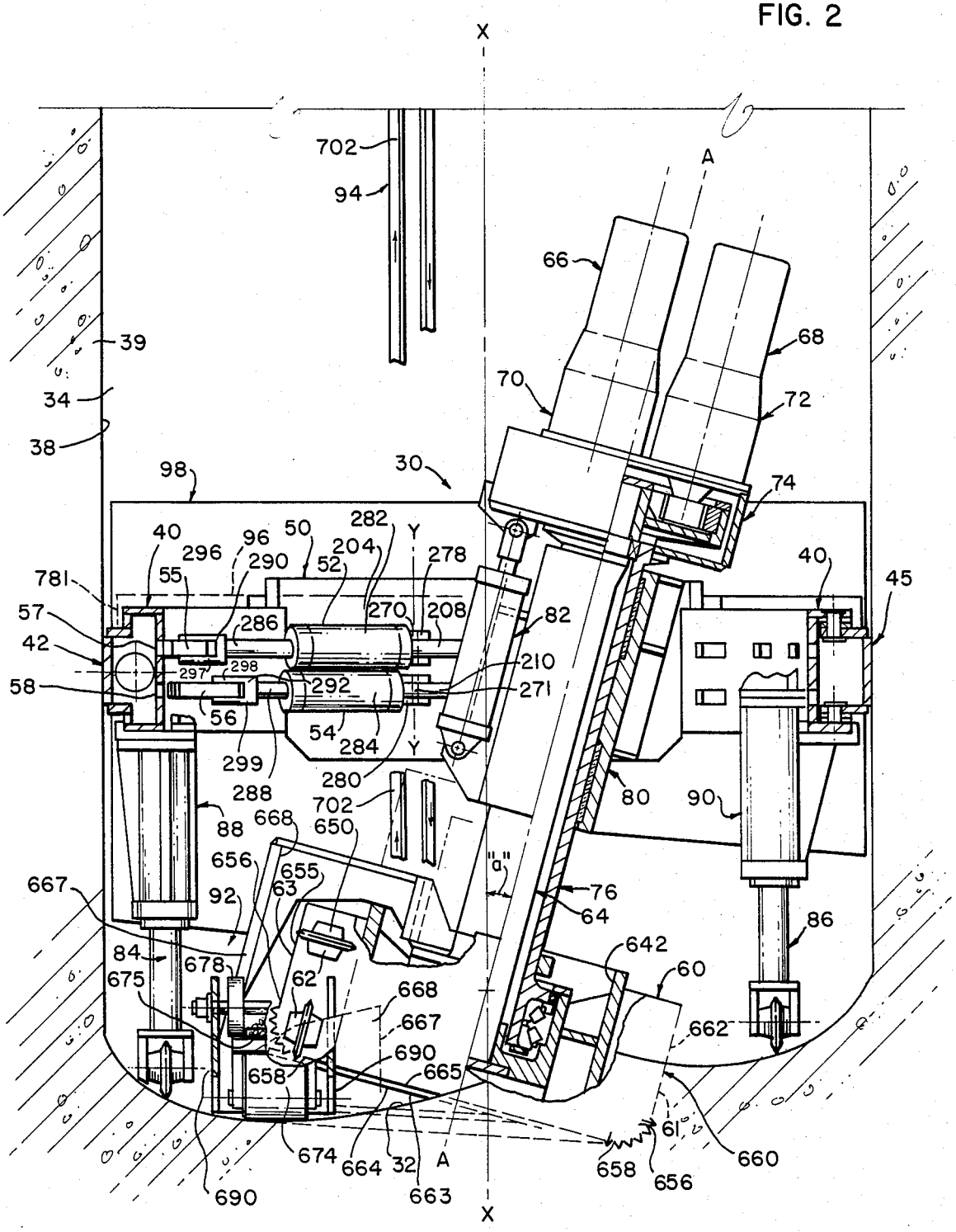
FIG. 2 is an elevation view of a shaft boring machine, with portions cut away shown in a cross-section of a shaft.

In general, FIGS. 1 and 2 show a shaft boring machine 30 of the present invention in cutting position at the bottom face 32 of an annular vertical shaft 34 of relatively large diameter (e.g. 14 to 38 feet) having a central longitudinal axis XX and an annular side wall 38 in a rock formation 39. It is to be understood that the shaft 34 is formed by cutting action and progressive downward movement of the machine 30 as hereinafter described.

Figure 6:
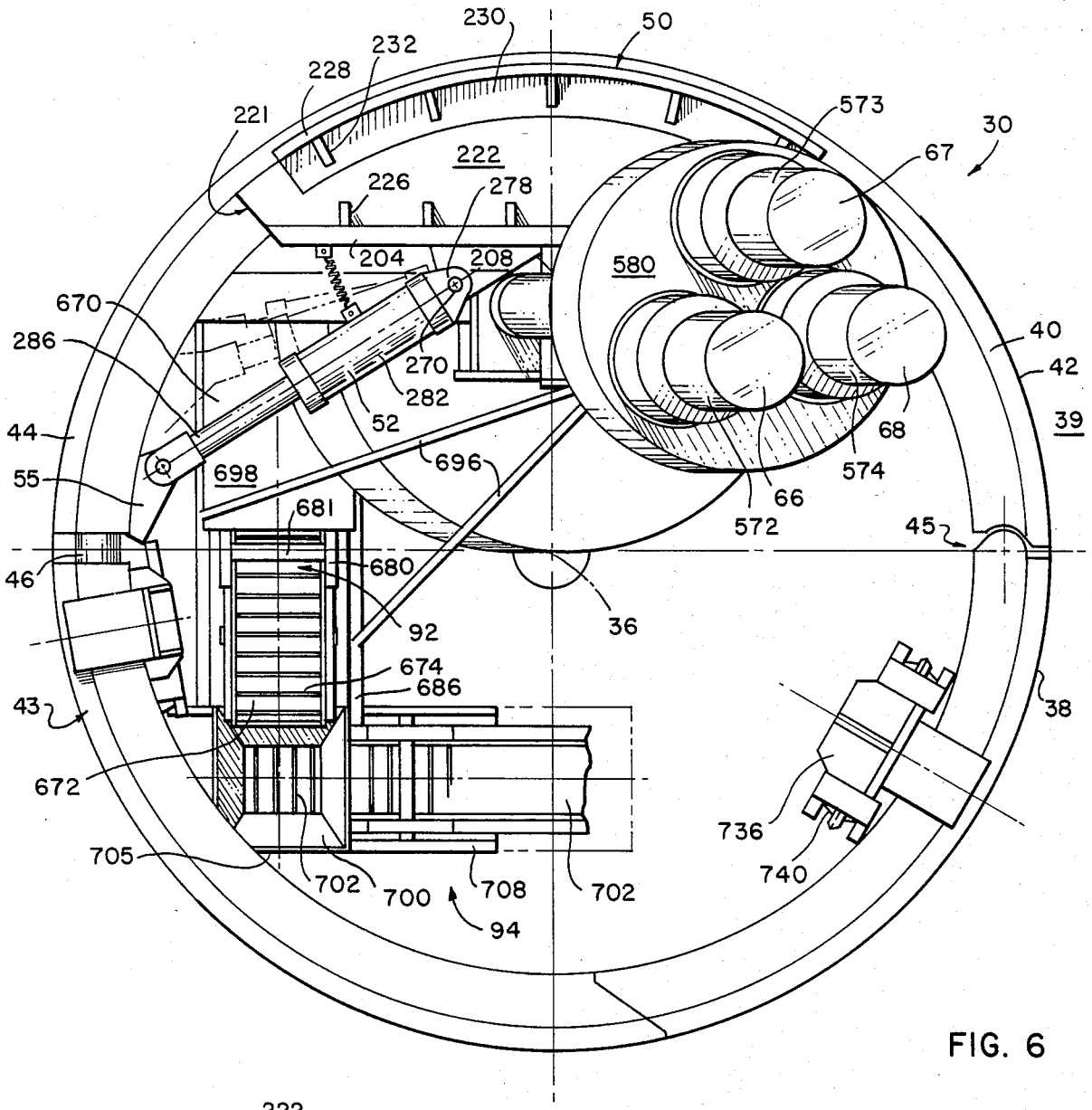
FIG. 6 is a top plan view of a shaft boring machine.
Figure 7:
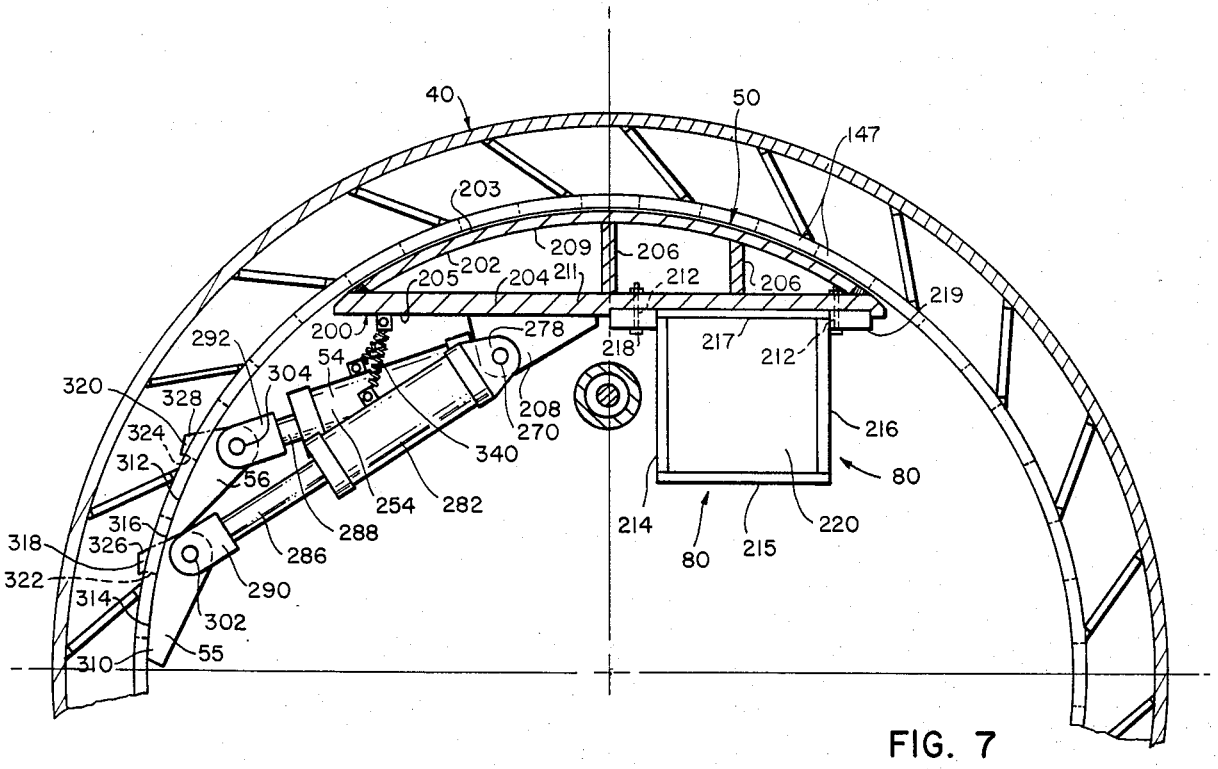
FIG. 7 is a cross-sectional top plan view of a support ring means and carriage means of a shaft boring machine.

The machine 30 comprises a support ring means 40 having a cylindrical outer peripheral surface 42 of approximately the same diameter as shaft 34. As shown in FIG. 3 through 6, support ring means 40 is made from two semi-circular members 43, 44 connected by a pivot means 45 and operable by a power cylinder means 46 or other linkage means such as a toggle, etc., for pivotal inward and outward movement between an outward clamping position in fixed engagement with a portion of the shaft side wall 38 whereat the machine is axially fixedly supported in the shaft and an inward unclamped position relative thereto whereat the machine is axially movable relative to the shaft. A carriage means 50, FIGS. 6 and 7, is movably supportably mounted on support ring means 40 for movement in a circular path therealong caused by drive cylinder means 52, 54 acting on drive shoe means 55, 56 received in circumferentially spaced slots 57, 58 on supporting means 40, FIG. 3. As shown in FIGS. 1 and 2, a rotatable cutter wheel means 60, having a plurality of cutting devices 62 mounted thereon for rotatably cutting the bottom face of the shaft to elongate the shaft, is carried by the carriage means. A rotatable drive shaft means 64 connects the cutter wheel means 60 to motor means 66, 67, 68 for rotatably driving the drive shaft means 64 through speed reduction gear means 70, 71, 72, and transmission box means 74. An axially displaceable torque tube means 76 supports the cutter wheel means 60, drive shaft means 64, motor means 66, 67, 68, and gear and transmission box means 70, 71, 72, 74. A support sleeve means 80 is mounted on carriage means 50 for slidably supporting the torque tube means 76 for axial movement between a downwardly extended position and an upwardly retracted position relative to the bottom face. A pair of downwardly extending retractable and extendable circumferentially spaced support leg means 84, 86 are operable by power cylinder means 88, 90 mounted on the support ring means 40 for enabling the machine to be supported on the bottom face of the shaft when the support ring means is retracted during operation of the machine to lower the supporting ring means 40. In the retracted unclamped position of the supporting means, the machine is supported at three circumferentially spaced points by the support leg means and the cutter wheel means. A conveyor means 92 for removing cuttings from the bottom of the shaft adjacent the cutting wheel means is mounted on torque tube means 76 adjacent cutter wheel means 60. A vertical conveyor means 94 is mounted on carriage means 50 for receipt of cuttings from horizontal conveyor means 92 and for conveying cuttings from the bottom of the shaft to a position above the machine for eventual removal at the top of the shaft. A work platform cover unit means 96, FIG. 1, is mounted on carriage means 50 for supporting control apparatus, machine workmen, replacement parts and the like. An annular upper shield means 98, FIGS. 1 and 2, may be affixed to the upper surface of unit 96 and extends circumjacent shaft wall 38 for enclosing machine components and protecting the workers from falling sidewall debris, etc. The cover unit 96 is fixedly attached to the carriage means 50 and support legs for maintaining the cutter wheel means and support leg means in fixed relationship.

It is to be noted that the cutter wheel means 60 has a diameter which is substantially less than the diameter of the shaft 34 being cut and an axis of rotation AA which is inclined relative to the shaft axis XX.

SUPPORT RING MEANS

Referring to FIGS. 3, 4, 5, and 8 it may be seen that each member 43, 44 of the support ring means has a generally T-shaped cross-section defined by a plurality of wall members oriented at right angles to one another.

Figure 8:
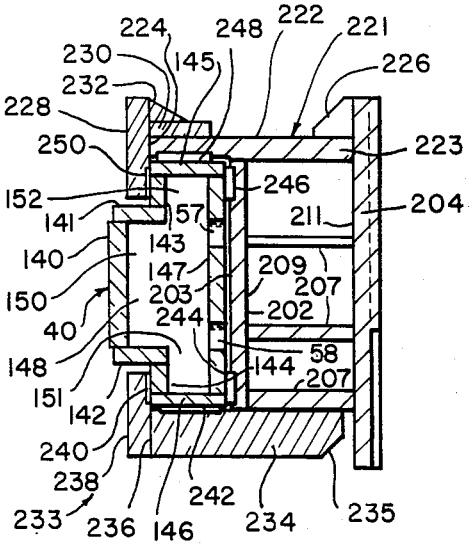
FIG. 8 is a detail cross-sectional elevation view of a support ring means and an attached portion of a carriage means of a shaft boring machine.

Referring to FIG. 8, the wall members comprise an outer vertical wall member 140 having radially inwardly extending horizontal wall members 141, 142 positioned at either end thereof. Each of the wall members 141, 142 have axially outwardly extending wall members 143, 144 positioned with the ends thereof distal wall member 140. The wall members 143, 144 in turn have radially inwardly extending horizontal wall member 145, 146 attached at the axially outwardly positioned ends thereof. The radially inwardly positioned ends of wall members 145, 146 are attached to opposite ends of an inner vertical wall member 147. The wall members 140–147 each comprise a generally elongate rectangular cross-sectional shape and may be attached to one another as by weldment, casting or other rigid attachment means well known in the art. Thus, support ring means 40 comprises a T-shaped interior cavity 148 as well as a T-shaped outer surface the trunk portion 150 of the T being defined by wall members 140, 141, and 142 and the branch portions 151, 152 being defined by wall members 143–147. The wall members 140–147 are constructed of a high strength rigid material capable of withstanding heavy loading and abrasion such as heavy steel plate or the like which may have a thickness on the order of 3 inches.

Figure 4:
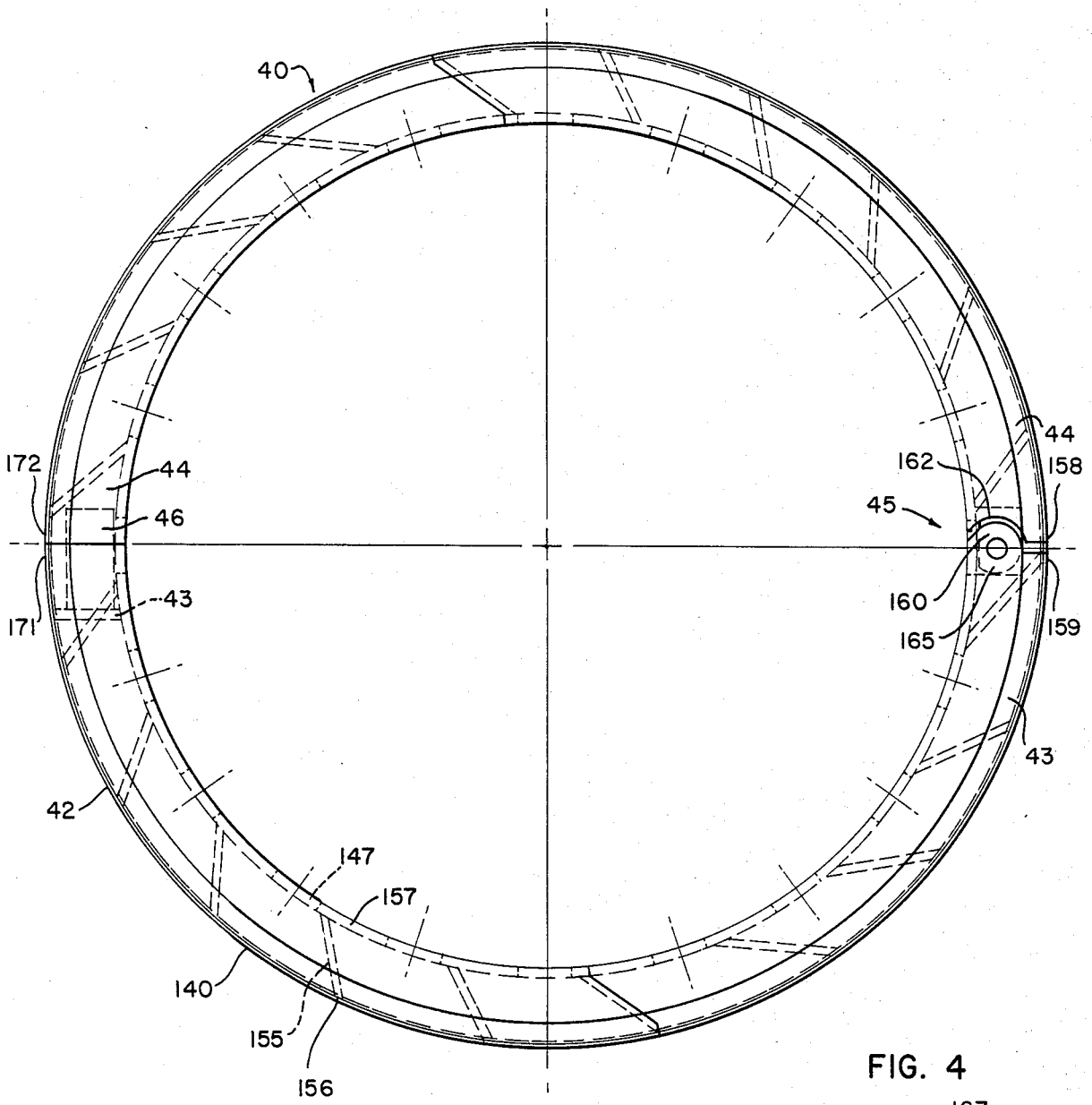
FIG. 4 is a top plan view of a support ring means for a shaft boring machine.

As illustrated by FIG. 4, support ring bracing means such as strut plates 155 may be employed to strengthen the support ring means. In the presently preferred embodiment, the strut plates are welded at both ends 156, 157 to inner and outer vertical wall members 140, 147 and are inclined at an angle of between 30° and 60° and preferably approximately 45° with respect to a radial line passing through end 156 for the purpose of resisting torque in the support ring means 40 produced by the forces from the drive cylinder means 52, 54 discussed hereinafter.

Figure 3:
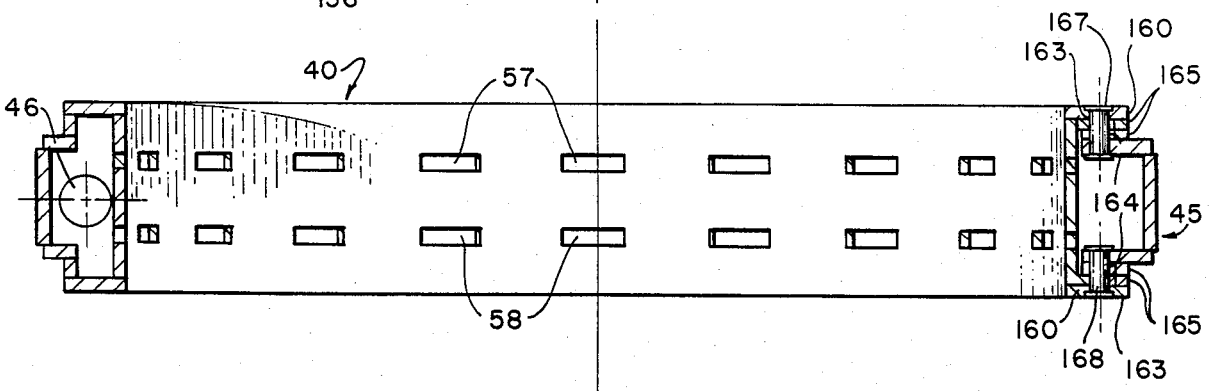
FIG. 3 is a partially cross-sectional elevation view of a support ring, means for a shaft boring machine.
Figure 9:
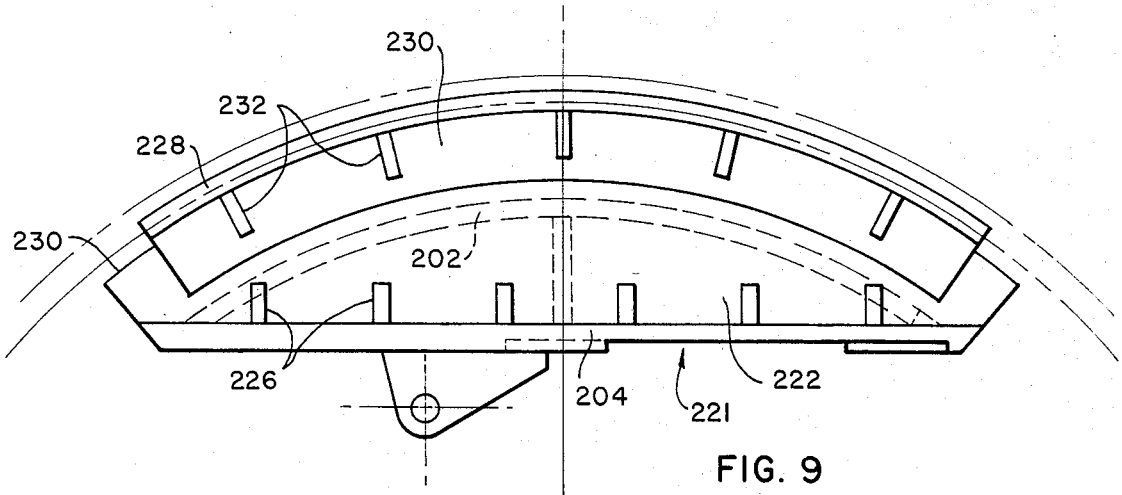
FIG. 9 is a top plan view of a carriage means of a shaft boring machine.

As illustrated by FIGS. 3 and 4, support ring semicircular members 43, 44 are pivotally attached to one another by a pivot means 45. As shown by FIG. 4, end portions 158, 159 of each member are constructed and arranged whereby a curvilinear outwardly projecting wall portions 160, at the upper and lower surfaces of member 43 is received in non-interferring relationship by a curvilinear inwardly projecting cutout portion 162 in the upper and lower surfaces of circular member 44.

Holes 163 in outwardly projecting portions 160 are aligned with holes 164 in outwardly projecting portions 165 of member 44 positioned axially inwardly of cutout portion 162 in touching or near touching relationship with portions 160, FIG. 3. The holes 163, 164 receive pivot pins 167, 168 such as rivets, etc. Thus, members 43 and 44 may be pivoted at pivot means 45 with respect to one another by tangential displacement of ends 170, 171 with respect to one another.

Figure 5:
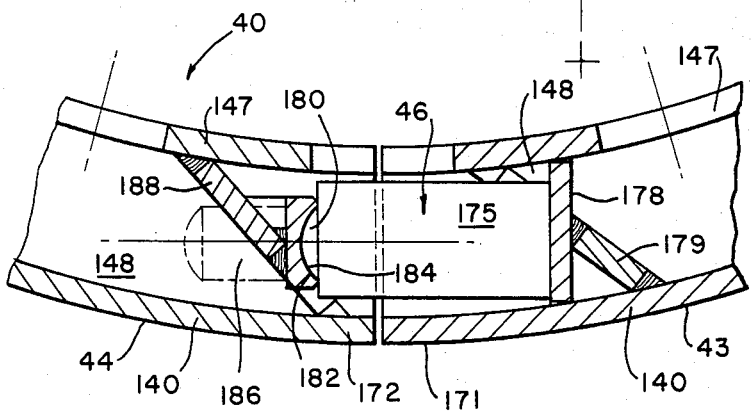
FIG. 5 is a top plan cross-sectional detail view of a portion of a support ring means of a shaft boring machine.

As illustrated by FIG. 5, end portions 171, 172 of members 43 and 44 are mounted with a clamping means such as power cylinder means 46 for providing axial movement of end 171 relative end 172. The power cylinder means 46 may comprise a cylinder barrel 175 mounted in fixed relationship in the interior cavity 148 of member 43 as by a radial brace 178 and diagonal strut 179 welded or otherwise rigidly attached to inner and outer walls 147, 140. The cylinder barrel 175 conventionally supports an extendable piston arm 180 which has a convex end surface 182 thereon which is received in abutting engagement by a concave surface 184 on piston receiving piece 186 rigidly mounted in the internal cavity 148 of member 44 as by diagonal plate member 188 rigidly attached to inner and outer walls 147, 140. The power cylinder means 46 may be operated by conventional hydraulic means or other means well known in the art to cause piston 180 to extend from barrel 175 and bring piston end surface 182 into abutting contact with receiving surface 184 whereby the ends 171, 172 of members 43, 44 are urged apart causing the members 43, 44 to pivot outwardly about pivot means 45 and thereby bring outer wall 140 into abutting, gripping and supporting relationship with the shaft annular side wall 38. Retracting piston 180 causes the support ring means members 43, 44 to be released from wall abutting engagement, allowing the support ring means 40 to be repositioned with respect to the shaft annular side wall 38 for lowering of the ring means as the shaft boring progresses. Other means for pivoting the members 43, 44 might, of course, also be used such as for example toggle linkage means (not shown).

An upper and lower row of equally spaced apart slots 57, 58, FIG. 3 and 8, are provided on the inner wall member 147, the slots 57 in the upper row being positioned directly above the slots 58 in the lower row. The slots may have a height of approximately 4 inches and a circumferentially measured width of approximately 12 inches. The slots are provided for engaging drive shoes 55, 56 as discussed in further detail hereinafter.

CARRIAGE MEANS

The carriage means 50 will now be described with reference to FIGS. 2, 6, 7 and 8. Referring to FIG. 7 it may be seen that the carriage frame 200 comprises an arcuate cross-sectional shape having an arcuate member 202 with an arcuate outer peripheral surface 203 positioned in abutting contact with the inner peripheral wall members 147 of the support ring means 40. The arcuate member 202 comprises a circular arc of approximately 70° in the presently preferred embodiment of the invention. A chord member 204 is positioned in chord relationship to the arc formed by the arcuate member 202 and is fixedly attached to the ends of the arcuate member 202 as by weldment or other rigid attachment means well known in the art. Carriage frame vertically aligned bracing plates 206 may be positioned in perpendicular alignment with the chord member 204 and rigidly attached to the arcuate member and chord member inner walls 209, 211 by rigid attachment means such as weldments or the like. The arcuate member 202 extends vertically a distance approximately equal to that of the support ring means inner peripheral wall member 147 as illustrated by FIG. 8. The chord member 204 extends vertically slightly higher and slightly lower than the arcuate member 202 and has end portions which may extend horizontally over the support ring means upper wall 145, FIG. 1. Chord member 204 is further supportedly and rigidly attached to arcuate member 202 by horizontal support members 207 and by horizontal top cap 221 as illustrated in FIG. 8. The horizontal top cap 221 comprises a horizontally extending top cap plate member 222 having a first end 223 affixed in abutting relationship with the radially remote side 211 of chord member 204 and having a second end 224 terminating at a point in alignment with the radially outwardly positioned surface of support ring means vertical wall member 143. A vertical retention member 228 is fixedly attached to end 224 in parallel alignment with wall member 143 and abuttably engages wall member 143 through a bearing means 250. The vertical retention member 228 may extend vertically upward beyond cap plate horizontal member 222 for the purpose of being provided with additional strengthening support through attachment pieces such as horizontal attachment piece 230 and vertical triangular welding plate 232. Similarly, a triangular, vertically upright support plate may be weldingly attached to the upper surface of horizontal member 222 and the radially outwardly positioned surface 211 of chord member 204. A bottom cap 233 may be attached to the lower most horizontal support member 207 by bolts (not shown) or other rigid attachment means well-known in the art. As shown by FIG. 8 the lower cap 233 comprises a horizontally extending bottom cap member 234 having a upwardly vertically extending vertical retention member 238 rigidly attached to the end thereof. The vertical retention member 238 is positioned in abutting alignment with clamping ring means wall member 144 with abutting engagement between the wall member 144 and the vertical retention member 238 provided through bearing means 240. A bearing means 242 is positioned in the upper surface of plate 234 in abutting contact with wall member 146. Bearing means 248 is similarly situated in the lower surface of horizontal member 222 in abutting, bearing relationship with wall member 145. Bearing means 244 and 246 are positioned in the radially remote vertical surface 203 of arcuate member 202 in abutting engagement with wall member 147.

Thus it can be seen that the carriage means 50 is retained on the branch portions 151, 152 of support ring means 40 in slideable abutting engagement therewith whereby the carriage means 50 is slideable through a full 360° of revolution about the interior of the support ring means. By providing a boltingly detachable lower cap 233 the carriage means 50 is rendered easily attachable and detachable from the support ring means 40 during erection and dismantling of the machine 30. Radially inwardly projecting carriage tongue members 208, 210, FIGS. 2, 6, and 7, are positioned in perpendicular abutting relationship with chord member 204 and are rigidly attached thereto as by weldments or the like. Tongue members 208, 210 comprise tongue member holes therein to provide pivotal attachment means for drive cylinder means 52, 54 as described in further detail hereinafter. Tongue members 208, 210 are positioned in substantially coplanar relationship with the upper and lower rows of slots 57, 58 in support ring means 40.

SUPPORT SLEEVE MEANS

Figure 11:
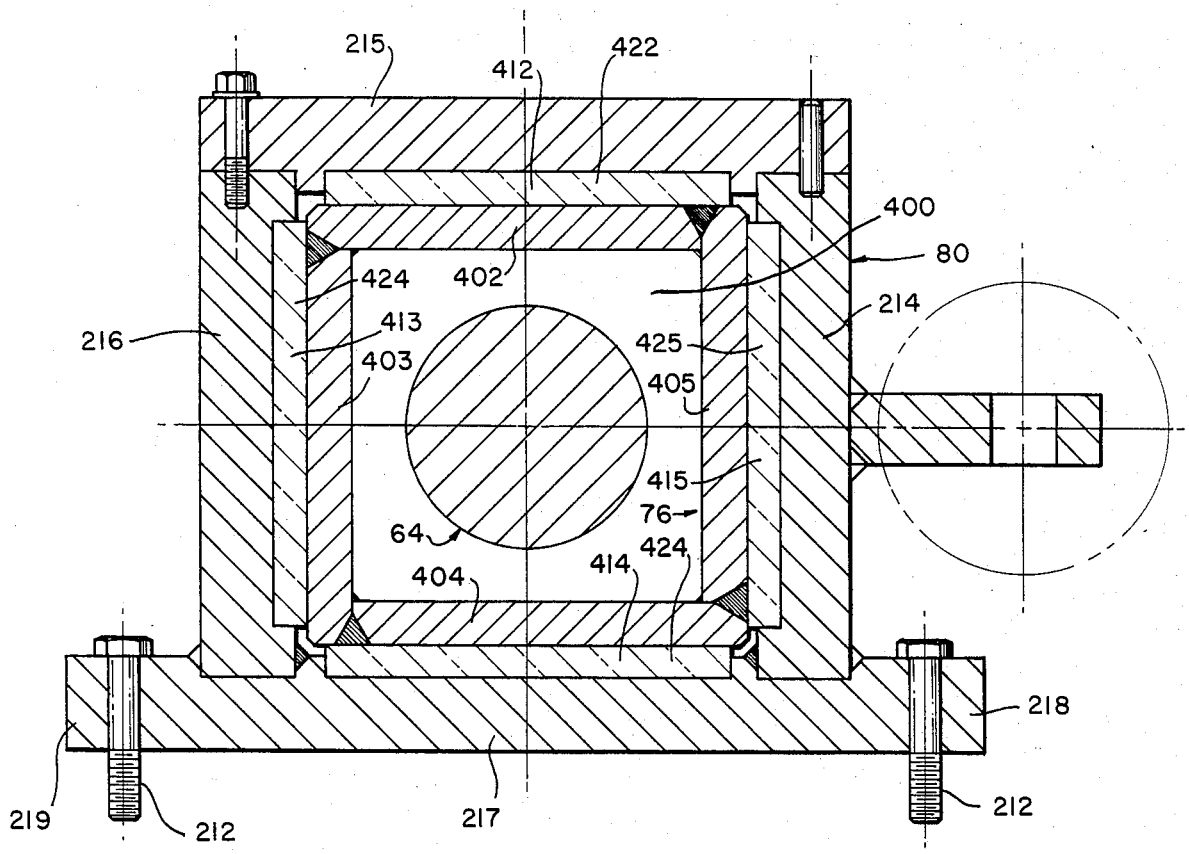
FIG. 11 is a cross-sectional top plan view of a sleeve means, torque tube means, and drive shaft means of a shaft boring machine.
Figure 10:
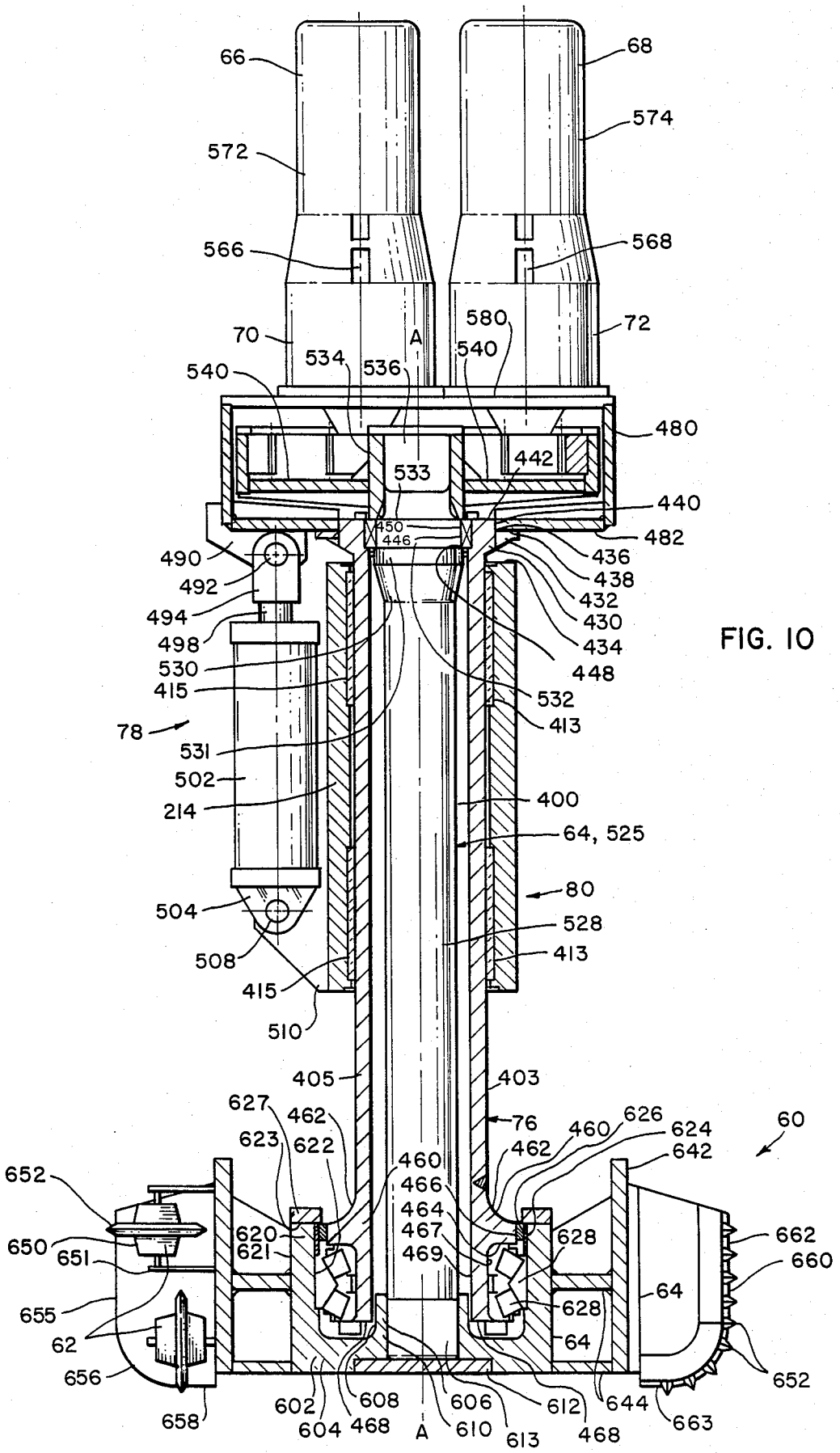
FIG. 10 is a cross-sectional elevation view of a portion of a shaft boring machine.

A cutting wheel support means such as support sleeve means 80 is provided for holding the cutting wheel means at a fixed angle of inclination relative shaft axis XX. As illustrated by FIGS. 7, 10, and 11, support sleeve means 80 has a generally rectangular configuration formed by support sleeve side wall members 214, 215 216 and 217. The support sleeve side wall members are fixedly attached at right angles to one another by rigid attachment means such as welding, bolts or the like. In the preferred embodiment wall 215 is boltingly detachable from walls 214 and 216, FIG. 11. The support sleeve means 80 is mounted on chord member 204 of the carriage means 50 with the outer surface of wall member 217 positioned in parallel abutting relationship with outer surface 205 of chord member 204. In the presently preferred embodiment support sleeve 80 is detachably mounted to the carriage means 50 by means of elongate flange members 218, 219 positioned in substantially coplanar relationship with side wall 217 and attached in rigid abutting relationship with wall members 214 and 216 as by weldment or the like. The flange members 218, 219 may be secured to chord member 204 by removable attachment means such as support sleeve nuts and bolts 212. As illustrated by FIG. 2 in the presently preferred embodiment, the support sleeve central axis AA is inclined along a plane parallel to chord member 204 at an acute angle "a" with respect to a plane perpendicular to chord member 204 and containing axis XX. The angle may be between 5° and 30° and in the presently preferred embodiment is substantially 15°.

In the presently preferred embodiment, the sleeve wall members 214–217 form an internal cavity 220 having a rectangular cross-section to facilitate sliding engagement with a torque tube means 76 having a similar cross-sectional configuration discussed hereinafter. The various wall and support plate members of the carriage means 50 and attached support sleeve means 80 are constructed from a high strength material such as steel plate having a thickness on the order of 3 to 5 inches.

CARRIAGE DRIVE MEANS

Carriage drive means for causing relative circumferential movement between the carriage means and the support ring means is provided by drive cylinder means 52, 54. As illustrated by FIGS. 2, 6, and 7, drive cylinder means 52, 54 are pivotally mounted on tongue members 208, 210 as by pivot pins 270, 271 passing through clevis holes in drive cylinder 52, 54 clevis portions 278, 280 whereby the drive cylinders are pivotal about an axis YY positioned substantially perpendicular to the planes of orientation of spaced slots 57, 58. Each cylinder means 52, 54 may possess a cylinder barrel 282, 284 and a selectively extendable and retractable piston arm 286, 288 conventionally mounted therein. Each piston arm 286, 288 in turn comprises a pivotal coupling means 290, 292 on its free end. Each pivotal coupling means 290, 292 may be a clevis member having prong portions 296, 297, 298, 299 with holes therein for accepting pivot pins 302, 304. Drive shoes 55, 56 having pivot pin accepting apertures therein and having a thickness slightly less than the height of slots 57, 58 are pivotally mounted in coupling means 290, 292 about pivot pins 302, 304 which are substantially parallel to tongue member pivot pins 270, 271.

Each drive shoe 55, 56 comprises an elongate toe portion 310, 312 having a clamping ring 40 engaging surface 314, 316 thereon. Each shoe also comprises a heel portion 318, 320 which projects outwardly from the toe portion. A forward surface of the heel portion 322, 324 is oriented substantially perpendicular to surface 314, 316 and may have a slightly convex shape for the purpose of engaging an edge portion of side wall member 147 through slot 57, 58. A rear surface 326, 328 of each heel may have a straight or slightly convex shape and may be oriented at an acute angle with respect to toe surface 314, 316. Each heel member 318, 320 may also be slightly tapered whereby the outer portion is narrower than the inner portion, the inner portion having a width substantially equal to that of slot 57, 58.

In operation, one shoe member 55 engages a slot 57 in the upper slot ring while the other shoe member 56 engages a slot 58 in the lower slot ring positioned above or immediately forward or rearward of the slot engaged by the other shoe. Both cylinder piston arms are, during the "driving" portion of their operation extended at a relatively constant rate of speed with a necessary amount of pressure exerted on an associated tongue member 208, 210 to move the cutter wheel means forward. After the rearward (upper) drive cylinder piston arm 286 reaches full extension it is slowly withdrawn into the barrel 282 while the barrel is simultaneously pivoted in a forward (clockwise from above) direction about axis YY by a drive cylinder rotation means such as pivot cylinders or spring assemblies 340.

The forward rotation of the drive cylinder 52 and retraction of piston arm 286 causes the drive shoe 55 to come forward out of the slot with which it was engaged. The continued forward motion of the drive cylinder and retracted of the piston arm 286 allows the shoe to move forward in sliding contact with the clamping ring surface until it is positioned with its heel portion 322 above the next succeeding slot. At this point the forward rotation of the cylinder 52 is halted as the piston arm 286 is once again extended, forcing the shoe 55 to rotate into engaging contact with the slot. A torsion spring (not shown) may be provided on each shoe to urge the shoe in a counter-clockwise direction (as viewed from above) to facilitate rotation of the shoe into an associated slot. Forward driving pressure may then be resumed by extending the piston arm at an appropriate preselected rate. The lower drive cylinder means, of course, follows the same sequence of operation upon reaching full extension. The drive cylinders may be moved forward in a manner suited to the particular work environment encountered. For example, when high forces are required the two cylinders may be moved into an orientation with one seated directly above the other to allow simultaneous extension of the piston arms to produce maximum forward pressure. In situations where lower forces are adequate, the cylinders may be moved forward in a staggered arrangement, each cylinder being seated in every other slot of its associated slot ring. The forward driving pressure in this arrangement may be applied by one cylinder at a time, with the cylinder which is not applying the driving force being moved forward during the other's "driving period".

The drive cylinders 52, 54 may be operated at variable pressure to accommodate different earth strata conditions encountered. The drive cylinder may be operated by conventional hydraulic drive means (not shown) which in the preferred embodiment are conventionally manually operated. In an alternative embodiment the hydraulic drive means are automatically operated with manual override. The amount of pressure being applied may be monitored and calculated by conventional means such as from the amperage meter (not shown) reading of one of the cutter wheel electric drive motors 66, 67, 68.

TORQUE TUBE MEANS

An axial shifting means for enabling axial movement of the cutting wheel means and drive shaft means relative the support ring means and carriage means is provided as by torque tube means 76. As illustrated most clearly in FIGS. 10 and 11, the torque tube means 76 in the presently preferred embodiment comprises an elongate tubular member having a rectangular internal cavity 400. The rectangular cavity 400 is defined by the inner surfaces of torque tube side walls 402, 403, 404 and 405. The outer surface of each torque tube side wall is supported in sliding bearing relationship by an upper and lower bearing means 412, 413, 414 and 415. Each bearing means may have a generally rectangular shape and may be supported in bearing means rectangular recesses 422, 423, 424, 425 in sleeve means 80 side walls 414, 415, 416, 417. The bearing means enable sliding axial movement of the torque tube means 76 within the sleeve means 80. As illustrated by FIG. 10 an enlarged upper portion 430 of the torque tube means limits the downward travel of the torque tube means within the sleeve means 80. In the presently preferred embodiment, each torque tube sidewall 402–405 comprises a radially outwardly, axially upwardly sloping surface 432 which intersects the axially extending outer wall surface and engages the upper end surface 434 of the sleeve means 80 when the torque tube means 76 is in a fully downwardly extended position. Each torque tube wall also comprises outer shoulder portion 436 having a radially extending surface 438 and an axially extending surface 440. Each torque tube wall also has a inner, circular, recessed portion 446 having a radially extending surface 448 and an axially extending surface 450. The two axially extending surfaces 440, 450 terminate at radially extending upper edge surface 442.

It may also be seen from FIG. 10 that the lower portion of the torque tube means 76 comprises a radially outwardly extending circular flange portion 460 positioned a short distance above the wall lower end surface 468. The circular flange portion 460 may, in cross section as illustrated in FIG. 10, comprise a curvilinear upper surface 462 and a generally flat radially extending lower surface 464 connected by a straight axially extending end surface 466 which forms the circular outer peripheral wall surface of the flange 460. The portion of the torque tube means 76 positioned below circular flange 460 has a circular outer surface 467 and a circular inner surface 469 (as viewed in an axial direction, not shown).

As shown by FIG. 10 a transmission box housing 480 is fixedly mounted to the torque tube means 76. In the presently preferred embodiment, the housing 480 comprises a radially extending base plate 482 having a rectangular cutout portion in the center thereof which enables the transmission box housing 480 to be fixedly attached to the torque tube means about the outer shoulder portion 436 thereof as by bolts or other conventional attachment means well known in the art. A transmission box tongue member 490 fixedly attached to the transmission box base plate 482 and aligned in coplanar relationship with a plane passing through central axis AA is provided with a pivot pin receiving hole to enable attachment of axial cylinder 78 as by an axial cylinder clevis 494 and pivot pin 492. The axial cylinder clevis 494 is in turn attached to piston arm 498 which is conventionally extendably and retractably mounted in cylinder barrel 502. The cylinder barrel 502 may in turn be provided with a barrel clevis 504 which is pivotally attached to sleeve tongue member 510 as by pivot pin 508. The sleeve tongue member 510 is fixedly attached as by weldment or the like to the outer surface of sleeve wall 214 in generally coplanar relationship with tongue member 490. Axial cylinder 78 may be conventionally operated to extend and retract piston arm 498, thereby selectively moving torque tube means 76, and apparatus fixedly attached thereto with respect to sleeve means 80. Thus, the torque tube means and attached apparatus may be moved generally upwardly or downwardly along axis AA.

ROTATABLE DRIVE SHAFT MEANS

As best illustrated by FIGS. 10 and 11, the cutting wheel rotatable drive shaft means 64 comprises an elongate shaft 525 having a circular cross-section. A main portion 528 of the shaft is centered within torque tube cavity 400 and extends through the entire length of the cavity. As shown by FIG. 10, the shaft main portion 528 is integral with an outwardly tapering portion 530 which is integrally formed with a radially enlarged portion 531 positioned near the top of the torque tube means 76. The enlarged portion 531 has an annular bearing ring 532 fixedly mounted thereon. The bearing ring 532 is rotatably supported on the torque tube inner recess 450 whereby the rotatable shaft means is prevented from moving axially downwardly with respect to the torque tube means 76 and whereby the upper portion of the torque tube is maintained in fixed spacial relationship with respect to the walls of the torque tube, while being rotatable therewithin. A second tapering portion 533 of the rotatable shaft means 64 is positioned immediately above the enlarged portion 531 whereby the shaft is necked down to its original diameter in an upper portion 536 positioned within transmission box housing 480. The upper portion 536 is annularly mounted with a conventional drive gear 534 which mates in a conventional fashion with transmission gears 540 provided in transmission box means 74 in a conventional ring gear arrangement well known in the art.

The lower terminal end 613 of the shaft main portion 528 is rectangular in shape as viewed along its axis and is maintained in fixed spacial relationship with torque tube means 76 and is rotatable therein with the cutter wheel means 60 fixedly attached to the shaft lower end 613 as described in further detail hereinafter.

MOTOR DRIVE MEANS

Motor drive means such as motor means 66, 67, 68 having axially oriented motor shafts 566, 567, 568 and mounted within elongate axially oriented motor housings 572, 573, 574 are conventionally mounted on speed reducer boxes 70, 71, 72 which in turn are conventionally mounted transmission means 74.

In the preferred embodiment the motor means 66, 67, 68 are standard electric motors well known in the art and may be AC, DC or variable frequency electric motors, having conventional electric motor controls. Other types of motors such as hydraulic motors might also be employed. Fossil fuel motors might be used but are not preferred because of fume and exhaust related problems.

CUTTER WHEEL MEANS

As best illustrated by FIG. 10, cutter wheel means 60 comprises a cutter journal member 602 having a radially extending body portion 604 with inner axially extending annular flange portion 606 projecting upwardly therefrom. The flange portion 606 comprises circular outer wall surface 608 positioned in spaced relationship from the torque tube means inner wall surface, and comprises a rectangular inner wall surface 610 positioned in abutting, fixed, engaging contact with the outer peripheral surface of drive shaft means 64 at the lower, rectangular, terminal end 613 thereof. An axle base plate 612 is fixedly mounted within a centrally positioned cutout portion in radially extending body portion 604 as by bolts or other conventional attachment means (not shown). An outer axially extending annular flange portion 620 projects upwardly from body portion 604 at the outer periphery thereof in concentric relationship with surface 608 of inner flange portion 606. The outer flange portion 620 comprises a circular outer surface 621 and a circular inner surface 622 and extends upwardly to a point whereat its upper edge surface 623 is positioned in alignment with the lower portion of the torque tube circular flange curvilinear upper surface 462. Inner surface 622 has an annular bearing ring 624 fixedly mounted thereon, which engages lip seal 626 which is maintained in position between bearing ring 624 and surface 466 by circular cap 627.

A double-roll-tapered-roller-bearing 628 is conventionally mounted on the circular surface portion 469 at the lower end of torque tube means 76. An outer race 628 is conventionally mounted on inner wall 622 of flange 620 in bearing receiving relationship with double-roll-tapered-roller bearing 628. Thus the cutter wheel means is journaled in a conventional manner about the lower end of torque tube means 76.

An annular cutter means support plate 642 is maintained in fixed concentric relationship with flange 620 as by structural members 644. The cutter means support plate 642 has a cylindrical outer surface 645 and supports a series of spaced apart cutter means 62 and radially extending paddle means as discussed in further detail below.

As shown by FIG. 2, the forward or leading portion 61 of the cutter wheel which engages the rock face is inclined downwardly and the rear or trailing edge portion 63 is inclined upwardly to facilitate muck removal. This result is accomplished, in the preferred embodiment by inclination of the cutter wheel axis of rotation AA relative the shaft axis XX.

Although the machine 30 described in the presently preferred embodiment has a drive shaft which is inclined relative the shaft axis XX, it would also be possible to construct a machine having drive shaft positioned parallel to axis XX and having a cutter wheel means with, for example, a hemispherically shaped peripheral surface with cutting devices mounted thereon. Such an arrangement would, because of the curved shape of the peripheral surface, facilitate muck removal from below the trailing edge of the rotating hemisphere. Other similar curvilinear surfaces might also be used with an axis of rotation in either parallel or inclined relationship with the shaft axis.

CUTTING DEVICES

As illustrated in FIGS. 1, 2 and 10, cutter means 62 may comprise a plurality of rolling cutter devices 650, mounted about the lateral peripheral surface of the cutter wheel means on support plate 642 as by brackets 651. As shown by FIG. 10, the cutter devices have a cutting edge 652 which rolls over the shaft wall surface crushing a shallow band of rock immediately beneath the cutting surface and creating associated fracture zones. A fracture zone extends from one crushed band to the other at a depth generally several times the depth of the crushed bands. The rock in the fracture zones separates from the rock wall surface and falls to the bottom of the shaft in the form of rock chips where it is thereafter moved by paddle means described in further detail below. This method of cutting a rock wall by the use of spaced roller cutter devices is often referred to as "spalling" and is well known in the art.

In the present invention, most of the cutter devices 650 are positioned with their axes of rotation in parallel alignment with drive shaft 64 whereby the cutting edges 652 roll in a plane perpendicular to drive shaft 64. However, a number of rollers are positioned with cutting edges 652 projecting from the lower curved edge portion 656 and bottom periphery 658, FIG. 2, of the cutter wheel means and therefore have axes which are inclined with respect to the drive shaft axis AA but which lie in radially projecting planes intersecting at axis AA.

Thus it may be seen that the rock cutting operation takes place at the leading edge (downwardly inclined) portion 61 of the rotating cutter wheel means at both the lateral periphery 655, a portion of the bottom periphery 658, and the peripheral edge 656 positioned therebetween, as illustrated in FIGS. 2 and 10.

PADDLE AND SHIELD MEANS

As rock chips are cut by the leading edge portion of the cutter wheel means, gravity causes the chips to fall downward to the shaft floor. Radially extending paddle means 660, FIGS. 2 and 10, are fixedly attached to 642 by conventional means such as weldment and have an outer axially extending edge surface 662 positioned and radially extending edge surface 663 positioned so as to allow the outer most portions of the cutter devices to protrude slightly therefrom. The paddle means "sweep" the rock chips along the shaft bottom in the direction of rotation of the cutter wheel means. A typical cutter-wheel may have on the order of 6 to 12 paddles. During the first portion of this sweeping motion the rock chips are contained between adjacent paddles and the bottom and sidewall portions of the trough shaped path being cut by the cutter wheel. However, at a position where a paddle has rotated a few degrees from the forward most point of the cutter wheel it is necessary to provide a ramp 663, FIGS. 1 and 2 along which the chips may be swept upwardly and rearwardly. The ramp 663 may be a wedge shaped shoe which has an upper ramp surface 664 oriented in parallel near touching relationship with the lower rotating edge 665 of the paddle means at a position associated with the radially (about axis AA) most remote half of the cutter wheel generally adjacent to the shaft side wall 38.

A muck shield 667 having an axially extending inner surface 668 may be attached at the outer periphery of the ramp 663 and may be supported on the torque tube means as by bracket means 669, FIG. 1. The ramp upper surface 664 and the shield inner surface 668 thus co-act with the paddle means 660 to contain the rock chips as they are swept rearwardly by the paddle means. The chips are discharged from the rearwardly positioned edge of the ramp into a horizontal conveyor means 92 described in further detail below.

CONVEYOR MEANS

As best illustrated by FIGS. 1 and 6 a horizontal conveyor means 92 is positioned, as viewed from above, in generally perpendicular alignment with chord member 204. The conveyor means 92 has a first end 670 positioned beneath the trailing portion of the cutter wheel means 60 and a second end 672 positioned radially inwardly from the cutter wheel means at a sufficient distance to clear the cutter wheel to allow rock chips 675 passing from the horizontal conveyor means to be accepted by a vertical conveyor means 96. The horizontal conveyor means 92 comprises a generally horizontally oriented conveyor belt 674 which accepts cutter rock chips on the upper surface thereof and conveys the chips to the vertical conveyor means 94. The belt 674 may be mounted on a series of conveyor rolls 676, 678, 682, etc. A depressor wheel means 680 may be mounted on an axle 681 positioned above the conveyor belt near the periphery of the cutter wheel means 60 to depress the belt 674 by engaging the outer edge surfaces thereof whereby the belt is held in clearing relationship with the cutter wheel means and rock chips 675 are allowed to pass beneath the depressor wheel axle 681. The chips after passing beneath axle 681 moves upwardly passing over roller 678 at which point it is sufficiently elevated to pass into vertical conveyor hopper 700. The horizontal conveyor means 92 may comprise a conveyor housing 686, FIG. 6, mounted on a skid 692, FIG. 12. Support struts 696, FIG. 6, may be rigidly attach to the housing 686 to cause the horizontal conveyor means 692 and the vertical conveyor means 696 which is attached to housing 686 to be moved with the cutter wheel means 60 as it rotates about the clamping ring 40.

The horizontal conveyor may be driven by conventional drive means such as an electric drive motor (not shown).

Figure 12:
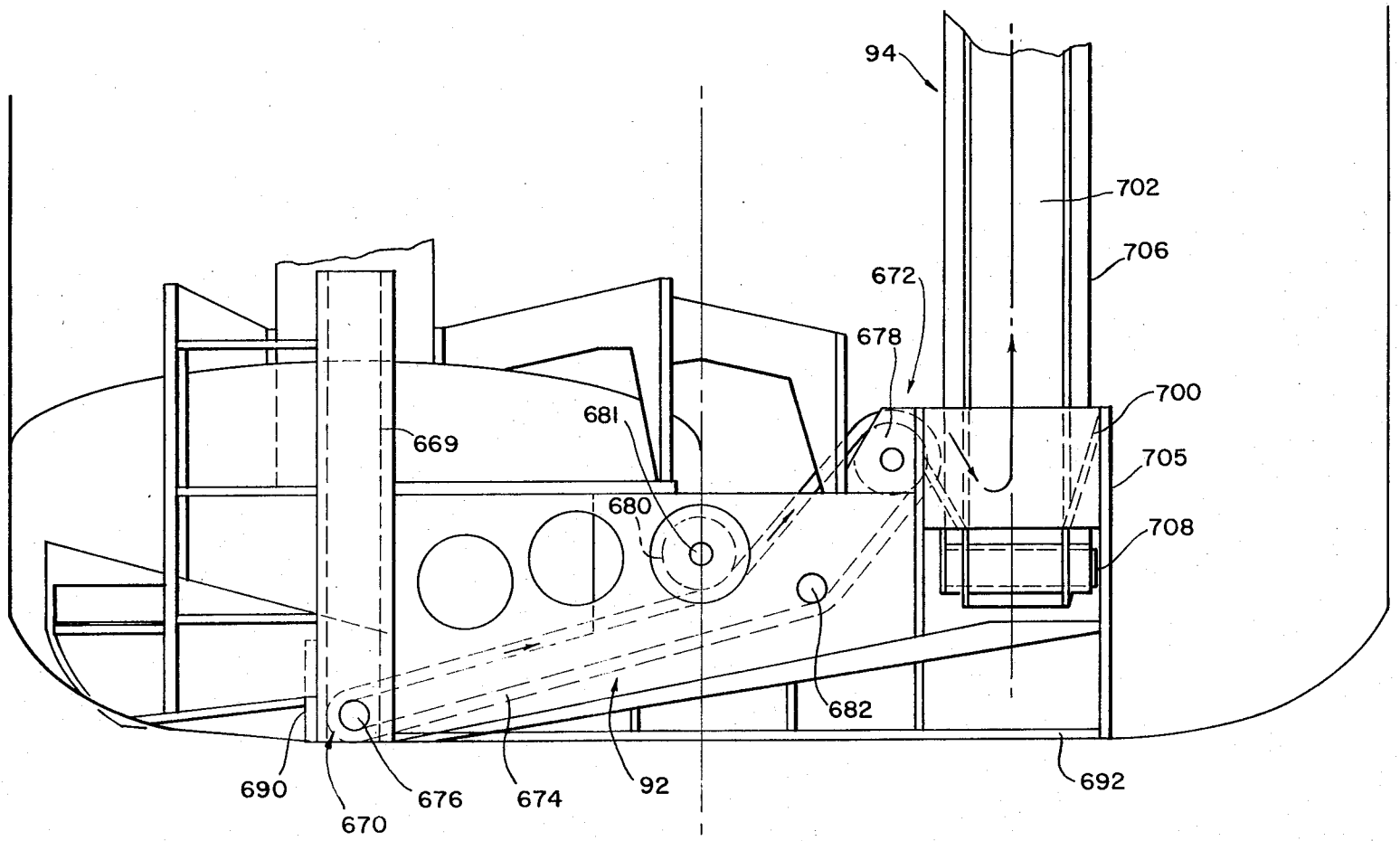
FIG. 12 is an elevation view of a portion of the muck system of a shaft boring machine.

As shown by FIGS. 1, 6, and 12, the vertical conveyor means 94 may comprise a vertical conveyor hopper 700 for accepting rock chips from the horizontal conveyor means 92. A vertical conveyor belt 702 may be conventionally mounted as on conveyor rolls 708. The vertical conveyor belt 702 may comprise container means 703, which may be buckets, flexible belt partitions, etc., FIG. 1, mounted thereon to aid in the transportation of rock chips 675 in the vertical direction. A vertical conveyor hopper housing 705, FIG. 12, may be provided to facilitate rigid connection of the vertical conveyor means 94 with the horizontal conveyor means housing 686. The vertical conveyor means 94 may also comprises a vertical belt housing 706 which facilitates attachment to the carriage means or to unit cover plate 96 by conventional structural members (not shown). The vertical conveyor belt may be driven as by an upper drive motor (not shown) conventionally attached to one of the rolls 708. Thus, it may be seen that both the horizontal and vertical conveyor are attached in fixed relationship with respect to the rotatable cutter wheel means 60 and operate to remove rock chips from an area below the trailing portion of the cutter wheel means 60 as it moves about the vertical shaft 34.

SUPPORT LEG MEANS

Figure 14:
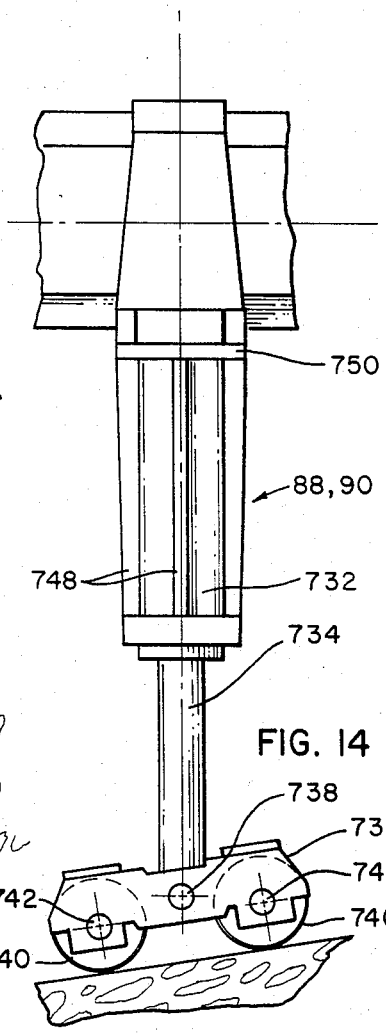
FIG. 14 is an elevation view of a support leg means of a shaft boring machine.
Figure 15:
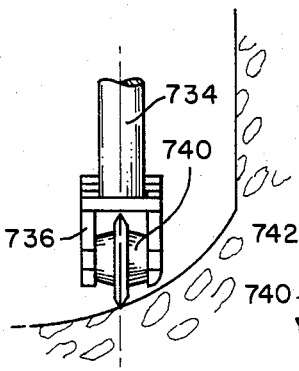
FIG. 15 is a detailed elevation view of a support leg means of a shaft boring machine.
Figure 13:
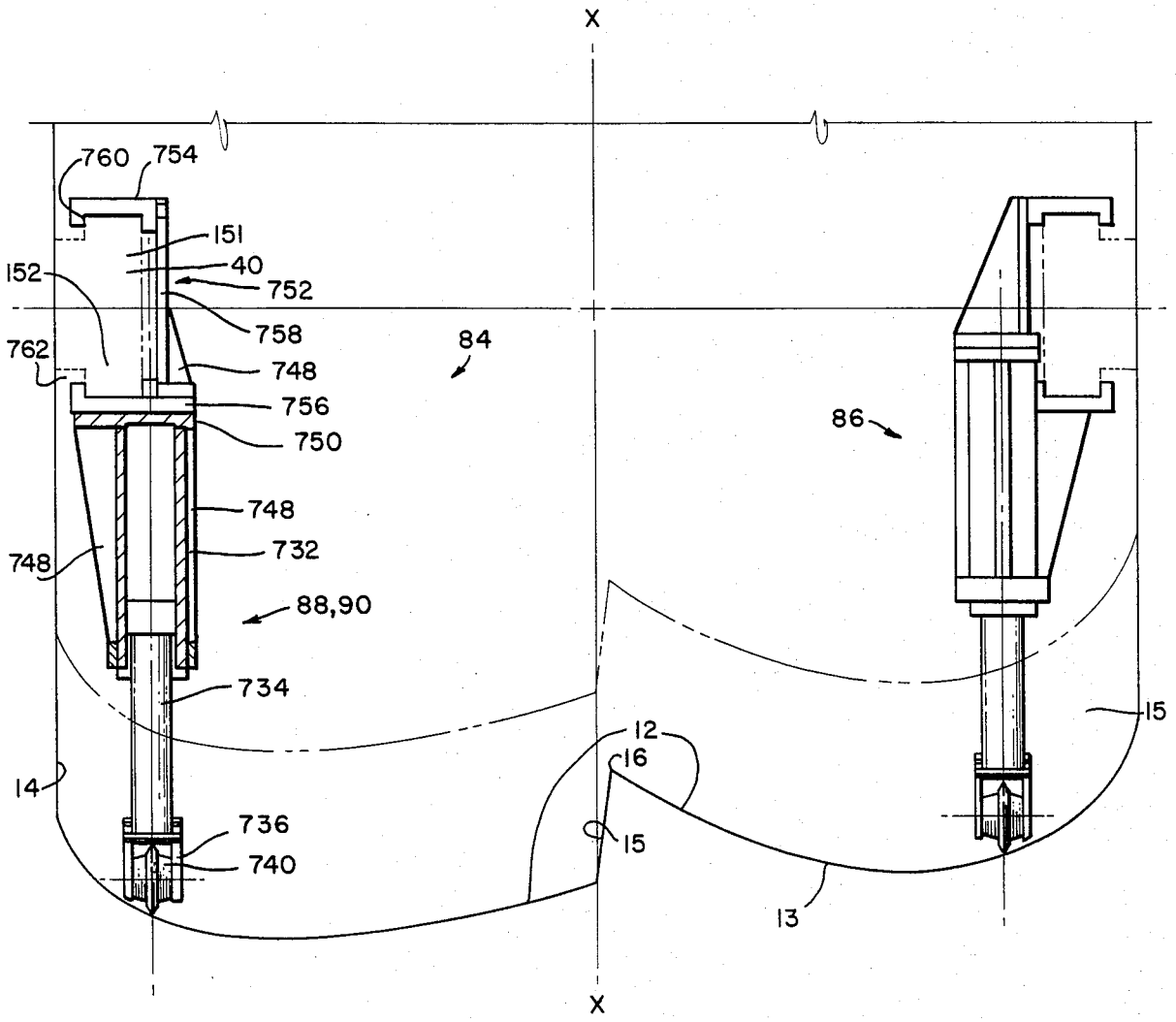
FIG. 13 is a partially cross-sectional elevational view of support leg means and support ring means of a shaft boring machine.

Each of the support leg means 84, 86 as best illustrated by FIGS. 13, 14 and 15 comprise a cylinder means 88, 90 oriented generally parallel to the shaft central axis XX. Each cylinder means in turn comprises a cylinder barrel 732 having an extendable and retractable piston 734 operably mounted therein. The cylinder means may comprise a conventional hydraulic cylinder or other extendable and retractable means well known in the art. A shaft surface contacting means such as roller carriage 736 may be pivotally mounted on piston 734 as by pivot pin 738. The roller carriage 736 has rollers 740 rotatably mounted therein on roller axles 742. As illustrated in FIG. 6 the roller carriage 736 is oriented in a direction tangental to the clamping ring 40 whereby it may move about a path defining a concentric circle positioned within support ring means 40. As shown by FIG. 13, and 14 cylinder barrel 732 is fixedly attached to a horizontal plate 750 by rigid attachment means such as weldment or the like and may be additionally structurally supported as by barrel support plates 748 welded to the barrel 732 and the horizontal plate 750. The horizontal plate 750 is in turn rigidly attached to a bracket means 752 mounted in slidingly retaining relationship with the support ring means 40. As illustrated by FIG. 13 the bracket means 752 may comprise upper and lower horizontal members 754, 756 fixedly attached to an elongate vertical member 758. Retaining flanges 760, 762 positioned at radially outwardly positioned ends of member 754, 756 engage the carrier means branch portions 151, 152 whereby the bracket 752 is slidably retained on the support ring means 40. Each piston 734 of the leg means 84, 86 may be conventionally extended or retracted whereby the carrier ring means may be selectively raised or lowered by piston actuation. As illustrated by FIG. 6 the support leg means 84, 86 are spaced about the clamping ring 40 at approximately equal distances from the cutter wheel means whereby a tripod relationship is created by the lower surfaces of the cutter wheel means and support leg means for supporting the support ring means 40. This arrangement allows the support ring means 40 to be properly positioned during each downward movement thereof prior to the beginning of a new circular cutting cycle. The pistons 734 are raised during cutting operations and only relowered when a cutting revolution has been completed and it is again time to lower the clamping ring 40. The leg means 84, 86 are rigidly attached to cover unit 96 as by welding, bolting, etc., and move with the carriage means 70 in fixed relationship therewith as it moves around the support ring means 40 during a cutting revolution.

COVER UNIT

As illustrated by FIG. 1, a circular cover unit 96 is provided at the upper surface of support ring means 40. The cover unit has a diameter approximately equal to the diameter of the outer edge of the branch portion of support ring means 40, above which it is slideable positioned. Annular flange 781, FIG. 2, positioned at the cover unit periphery, retains the cover unit in slidingly revolvable relationship with the support ring means. The cover unit is rigidly attached to carriage means 50 and to support leg means 86, 88 at upper surface portions thereof. The entire cover unit 96 thus revolves about the shaft central axis XX because of its connection with carriage means 50. The revolving movement of the cover unit is transmitted to support legs 84, 86 causing them to revolve about the carrier ring 40 in a fixed spacial relationship with the carriage means and thus cutter wheel means 60 whereby a spaced apart three point tripod relationship between the support legs 84, 86 and cutter wheel means 60 is maintained.

The cover unit contains cut out portions therein to accommodate upper portion of the machine 30 and vertical conveyor 94 which it may also support. The cover unit may also support control units 784, FIG. 1, operators, spare parts, vent lines, etc. In the preferred embodiment the cover unit 96 comprises a high strength frame work such as steel plate or the like and may have see-through portions therein to enable an operator to view the operations being preformed by various machine components.

OPERATION

In operation of the shaft boring machine, in most geological formations, the upper layer of soil type material (overburden) is excavated by conventional methods until the upper surface of the solid rock formation is reached. A shaft collar (not shown) having a diameter approximately the same as the diameter of the shaft to be cut, is then constructed above the rock face. The shaft boring machine is then located in the shaft collar with the cutter wheel adjacent the rock face. During operation of the machine, a downwardly extending cylindrical shaft is cut through the rock. The machine is gradually lowered into the shaft. It is initially supported by the shaft collar and, as the shaft is cut deeper, then supported by the shaft wall as the machine is lowered into the shaft.

FIG. 2 shows the machine in the shaft at the end of a 360° cut with the cutter wheel in a maximum downwardly displaced position relative to the carriage whereat the cylinder rod of the axial cylinder 82 is fully retracted. At this time, it is necessary to lower the carriage and support ring to the next cutting cycle position and reset the carriage and supporting ring in the next cutting cycle position. First, the support leg cylinders are actuated to lower the cylinder rods until the support wheels on the lower ends of the cylinder rods firmly engage the cut face of the rock and the cylinders are fixed in the extended position. The support legs and the cutter wheel, which are engaged with the rock face, will provide a three point suspension system for the machine. Then, the clamping cylinder is deactuated to release the clamping ring which then moves radially inwardly so that the entire weight of the machine is supported by the support legs and the cutter wheel. Then, the support leg cylinders and the thrust cylinder 82 are actuated to retract the support leg cylinder rods and extend the axial cylinder 82.

As the support leg piston rods are retracted at a controlled rate and the cutter wheel cylinder rod is extended, the weight of the carriage and clamping ring and apparatus mounted thereon causes downward movement thereof relative to the cutter wheel, which is fixedly supported on the rock face of the shaft, with the torque tube support sleeve sliding downwardly on the torque tube away from the drive motors. The lateral thrust caused by the movement of the torque tube sleeve along inclined axis AA is accommodated by a small rotational displacement of the carriage means, cover unit, and attached support legs relative the clamping ring which is enabled by the rotary wheels on the end of the support leg cylinder rods.

The movement of the cylinder rods may be controlled so that the vertical axis of the clamping ring may be properly positioned relative to the axis XX of the shaft. Thus, misalignment in the direction that the shaft is being sunk may be corrected during the lowering operation by "steering" the support ring into a proper orientation. The steering means is provided by the tripod relationship of the cutter wheel and support legs which may each be extended or retracted as needed to incline the plane of the support ring means in any desired direction to change or correct the direction in which the shaft is being sunk. Correction angles, etc., may be calculated by conventional surveying techniques.

After the carriage and clamping ring have been lowered and steering corrections completed, the clamping ring cylinder is actuated to move the clamping means from the retracted position back to the extended position whereat the carriage and clamping ring are fixedly secured to the shaft wall in the next cutting position. Then the support leg cylinders are actuated to retract the cylinder rods and the support wheels thereon. The machine is then ready to begin the next 360° cutting cycle.

During each cutting cycle, the cutting wheel is rotated by the drive motors through the reducer means and the drive shaft which is rotatably supported in the torque tube. The cutting wheel is circumferentially advanced along its arcuate path of movement by rotary movement of the carriage relative to the support ring 40 caused by actuation of the carriage drive cylinders. At the same time, the cutter wheel is forced downwardly against the rock face by actuation of the axial cylinder 82 at a controlled rate to cause retracting of the thrust cylinder 82 and downward sliding movement of the torque tube in the torque tube support sleeve which is fixed to the carriage. Thus, the cutter wheel simultaneously cuts the rock face in two right angle planes along the bottom and side surfaces of the cutter wheel in a downwardly extending helical cut path as illustrated by FIG. 16.

The rock chips are forced onto the horizontal bottom conveyor and transferred from the horizontal conveyor to the vertical conveyor for removal from the shaft as the cutter wheel advances around the centerline of the shaft.

The rate of advancement of the cutter wheel along its arcuate cutting path is controlled by the rate of operation of the carriage drive cylinders and may be varied as necessary or desirable depending upon the hardness of the rock being cut and related factors. The rate of downward advancement of the cutter wheel is controlled by the rate of operation of the axial cylinder 82 which is extended downwardly at a fixed rate relative to the amount of angular advance of the cutter wheel means, about the shaft. The carriage drive cylinders may be operated separately or together when necessary to overcome large resistance to the movement of the cutter wheel. In the preferred embodiment, a typical time required for completion of a 360° cutting cycle is approximately 45 minutes with an average depth of penetration of approximately 3 to 5 feet.

Figure 16:
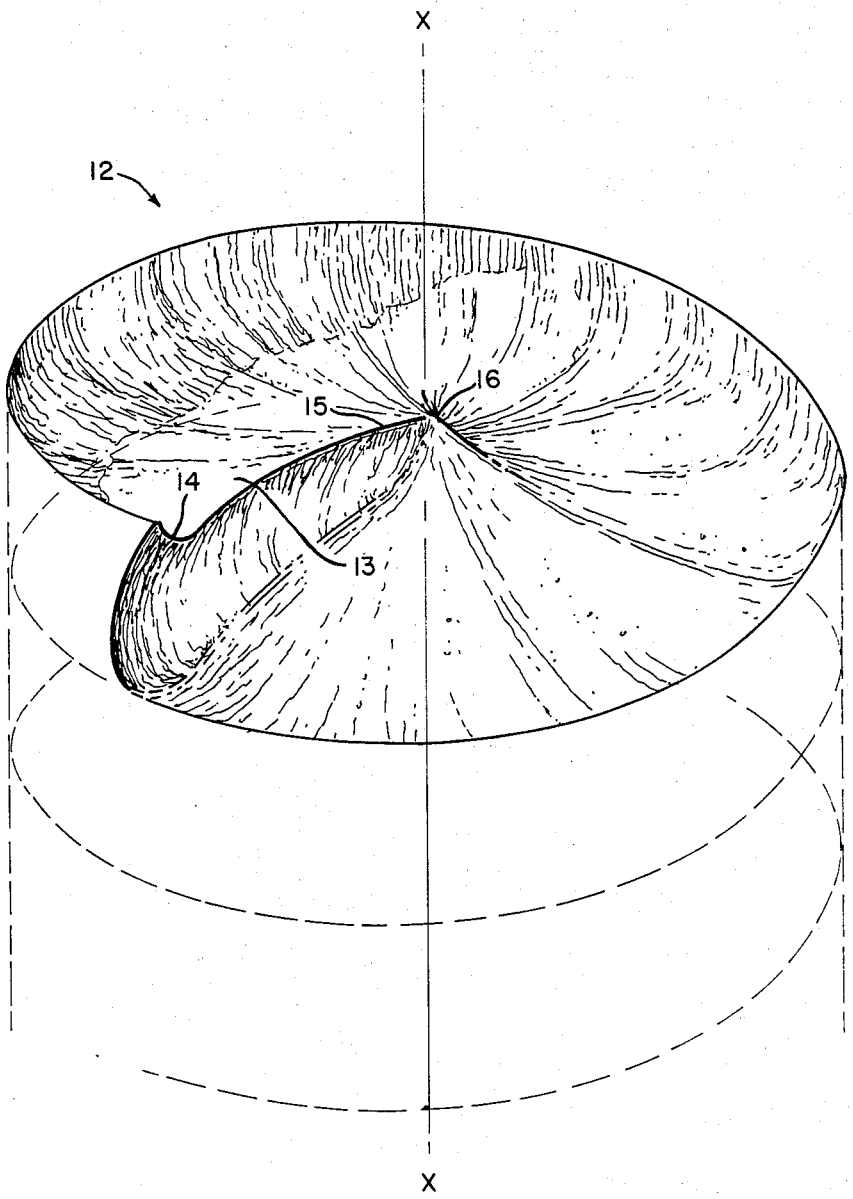
FIG. 16 is a transparent perspective view illustrating the path cut by a shaft boring machine.

The helical path 12 which is cut by the cutter wheel means is best illustrated by FIGS. 13 and 16. The path 12 is generally trough shaped having an arcuate bottom surface 13 and generally vertical side surfaces 14, 15. The inwardly positioned side surface 15 at the furthest point of cutter wheel advance forms a peak 16 with the bottom surface 13 of the previously cut portion of the path. A typical rate of drop in the path per revolution may be on the order of three to five feet for a machine boring a shaft having a diameter of 18 to 20 feet.

It is contemplated that the inventive concepts herein described may be variously otherwise embodied and it is intended that the appended claims be construed to include alternative embodiments of the invention except insofar as limited by the prior art.

The invention claimed is:

1. A machine for boring a shaft in earth strata or the like, the shaft having a generally cylindrical side wall and a face at one end thereof which is cut away by the machine, and comprising:

an annular support ring means for supporting the machine on the sidewall of the shaft during a cutting stroke having an outside diameter approximately equal to the diameter of the shaft for being located in closely spaced circumjacent relationship to the side wall of the shaft;

clamping means associated with said support ring means for causing selective clamping engagement of said support ring means with the side wall of the shaft to fixedly axially hold the machine in the shaft;

a carriage means movably mounted on said support ring means in fixed axial relationship thereto for 360° circumferential movement thereabout and relative thereto;

carriage drive means operatively mounted between said rotatable carriage means and said support ring means for causing relative circumferential movement therebetween;

a rotary cutting wheel means having a central axis of rotation supported by said carriage means and adapted to be located adjacent the end face of the shaft and having a diameter substantially less than the diameter of the shaft for cutting the end face of the shaft in a continuous spiral path to elongate the shaft during each 360° revolution of said carriage means;

cutting wheel drive shaft means supported by said carriage means for rotatably driving said cutting wheel means and having a longitudinal axis of rotation;

motor drive means operatively associated with said cutting wheel drive shaft means for causing rotation of said drive shaft means and said cutting wheel means;

cutting wheel support means for holding said cutting wheel means central axis of rotation and said cutting wheel drive shaft means at a fixed acute angle of inclination relative the axis of the shaft;

axial shifting means for enabling axial movement of said cutting wheel means and said drive shaft means relative to said carriage means and said support ring means toward and away from the end face of the shaft and for forcing said cutting wheel means into cutting engagement with the end face of the shaft during a single continuous extension of said axial shifting means as said cutting wheel means is carried around said support ring means whereby a continuous spiral cut of the end face is made during each 360° revolution of said carriage means.

2. The invention as defined in claim 1 and further comprising:

axially effective support means engageable with the end face of the shaft for supporting said support ring means during axial movement of the support ring means within the shaft from a finish position to a start position.

3. The invention as defined in claim 1 and further comprising:

support leg means mounted on said support ring means and being selectively extendible into supporting engagement with the end face of the shaft and retractable from engagement with the end face of the shaft whereby, upon release of said clamping means, the machine is supported by said support leg means to enable said support means and said carriage means to be moved axially in the shaft toward the end face to a new advanced cutting position.

4. The invention of claim 1 wherein said rotary cutting wheel means shape comprises a substantially cylindrical lateral surface, and a circular base surface wherein cutter devices are operably mounted on said cylindrical lateral surface and on an outer peripheral portion of said circular base surface.

5. The invention as defined by claim 4 and further comprising a rotatable cover unit means mounted on an upper surface portion of said peripheral support means and rotatable thereon for supporting machine control units, operators, etc., wherein said rotatable cover unit means is fixedly attached to said moveable carriage means and said support leg means and wherein said carriage means and said support leg means maintain a fixed configuration during rotation with respect to said peripheral support means.

6. The invention of claim 1 wherein said cutting wheel drive shaft means comprises a longitudinal axis of rotation which is coaxial with the axis of rotation of said rotary cutting wheel means wherein said drive shaft means longitudinal axis is inclined relative the axis of the shaft in a plane substantially tangential to the direction of circumferential movement of said carriage means.

7. The invention as defined by claim 1 wherein said rotary cutting wheel means comprise a rotating state in which said cutting wheel means is rotating about said drive shaft means and wherein, during said rotating state, said cutting wheel means comprises a leading portion positioned in the direction of forward circumferential movement and a trailing portion positioned diametrically opposite said forward portion wherein said trailing portion has the cutting surface therein positioned in a substantially vertically spaced apart relationship with the end face of the shaft, the space between said trailing portion and the end face defining a cutting removal space.

8. The invention as defined by claim 1 wherein said rotary cutting wheel means comprises radially extending paddle means operably mounted thereon for sweeping cuttings cut by said cutting wheel means in a rearwardly direction relative the direction of circumferential advance of said carriage drive means.

9. The invention as defined by claim 8 further comprising ramp and shield means for facilitating the movement of rock cuttings by said paddle means.

10. The invention as defined by claim 1 wherein said carriage drive means comprises drive cylinder means operably mounted on said carriage means and effectively engageable and disengageable with said support means.

11. The invention as defined by claim 10 wherein said drive cylinder means comprise:

a first drive cylinder pivotally mounted on said carriage means and pivotal about a first drive cylinder axis which is substantially parallel to the axis of said support means;

a second drive cylinder pivotally mounted on said carriage means in spaced apart relationship with said first drive cylinder and pivotal about a second drive cylinder axis which is substantially coaxial with said first drive cylinder axis;

a first piston arm operably associated with said first drive cylinder;

a second piston arm operably associated with said second cylinder;

first shoe means pivotally mounted on said first piston arm distal said first drive cylinder for engaging first slot means in said support means;

second shoe means pivotally mounted on said second piston arm distal said second drive cylinder for engaging second slot means in said support means;

first slot means positioned in said support means in coplanar relationship with the plane of rotation of said first drive cylinder about said first drive cylinder axis for receiving portion of said first shoe means in drivingly abutting engagement; and second slot means positioned in said support means in coplanar relationship with the plane of rotation of said second drive cylinder about said second drive cylinder axis for receiving portions of said second shoe means in drivingly abutting engagement.

12. The invention as defined by claim 11 further comprising drive cylinder rotation means for selectively rotating said first and second drive cylinder about said first and second drive cylinder axes whereby said first and second shoe means may be advanced from slot to slot in said first and second slot means.

13. The invention as defined by claim 1 wherein said axial shifting drive means comprises:

an axial cylinder operably mounted on said rigid tube means;

an axial piston arm operably piston associated with said axial cylinder and selectively extendable and retractable parallel to said rigid tube means; said piston arm being operably attached to said drive shaft mounting means.

14. The invention as defined by claim 1 wherein said clamping means comprises a clamping cylinder means for displacing opposed end portions of said peripheral support means in a tangential direction whereby the circumference of said peripheral support means is selectively variable.

15. A shaft boring machine for boring a shaft in earth strata or the like, the shaft having a side wall and an end face wall upon which the machine is operative, and comprising:

peripheral support means having an outer peripheral configuration generally corresponding to the cross-sectional configuration of the shaft for being located adjacent the side wall of the shaft and for supporting the machine in the shaft;

clamping means associated with said support means for selectively causing said support means to be grippingly associated with the side wall of the shaft whereby the machine is supported in fixed axial relationship to the shaft, and to be non-grippingly associated with the side wall of the shaft whereby the machine is axially movable toward the face of the shaft;

movable carriage means mounted on said support means for 360° circumferential movement relative thereto;

carriage drive means mounted between said support means and said carriage means for causing 360° circumferential movement of said carriage means relative to said support means;

a drive shaft mounting means mounted on said carriage means for 360° circumferential movement therewith;

an elongated rigid tube means slidably mounted in said drive shaft mounting means for axial movement relative to said carriage means toward and away from the face of the shaft;

a drive shaft means mounted in said rigid tube means;

a rotatable cutter wheel means mounted on one end of said rigid tube means adjacent the end face of the shaft and being operatively connected to said drive shaft means for rotatable cutting engagement with the end face of the shaft;

cutter wheel drive means operatively connected to said drive shaft means for rotatably driving said cutter wheel means during engagement of said cutter wheel means with the end face of the shaft; and axial shifting drive means operatively connected to said rigid tube means for causing axial displacement of said rigid tube means and said cutter wheel means relative to said carriage means axially toward and away from the end face of the shaft during circumferential movement of said carriage means relative to the end face of the shaft whereby said cutter wheel means makes a 360° helical cut in the end face of the shaft during each 360° revolution of said carriage means.

16. The invention as defined in claim 15 and further comprising:

support leg means mounted on said support means and being selectively extendible into supporting engagement with the end face of the shaft and retractable from engagement with the end face of the shaft whereby upon release of said clamping means, the machine is supported by said support leg means to enable said support means and said carriage means to be moved axially in the shaft toward the end face to a new advanced cutting position.

17. The invention as defined by claim 4 and further comprising a rotatable cover unit means mounted on an upper surface portion of said peripheral support means and rotatable thereon for supporting machine control units, operators, etc., wherein said rotatable cover unit means is fixedly attached to said moveable carriage means and said support leg means and wherein said carriage means and said support leg means maintain a fixed configuration during rotation with respect to said peripheral support means.

18. The invention of claim 17 wherein said axial shifting drive means comprises:

an axial cylinder operably mounted on said rigid tube means;

an axial piston arm operably associated with said axial cylinder and selectively extendable and retractable parallel to said rigid tube means; said piston arm being operably attached to said drive shaft mounting means.

19. The invention of claim 4 wherein said rotatable cutter wheel means shape comprises a substantially cylindrical lateral surface, and a circular base surface wherein cutter devices are operably mounted on said cylindrical lateral surface and on an outer peripheral portion of said circular base surface.

20. The invention of claim 19 wherein said drive shaft means comprises a longitudinal axis of rotation which is coaxial with the axis of rotation of said rotatable cutter wheel means wherein said drive shaft means longitudinal axis is inclined relative the axis of the shaft in a plane substantially tangential to the direction of circumferential movement of said movable carriage means.

21. The invention of claim 20 wherein said rotatable cutter wheel means comprise a rotating state in which said cutter wheel means is rotating about said drive shaft means and wherein, during said rotating state, said cutter wheel means comprises a leading portion positioned in the direction of forward circumferential movement and a trailing portion positioned diametrically opposite said forward portion wherein said trailing portion has the cutting surface therein positioned in a substantially vertically spaced apart relationship with the end face of the shaft, the space between said trailing portion and the end face defining a cutting removal space.

22. The invention of claim 20 wherein said rotatable cutter wheel means comprises radially extending paddle means operably mounted thereon for sweeping cuttings cut by said cutter wheel means in a rearwardly direction relative the direction of circumferential advance of said carriage drive means.

23. The invention of claim 20 further comprising a rotatable cover unit means mounted on an upper surface portion of said peripheral support means and rotatable thereon for supporting machine control units, operators, etc., wherein said rotatable cover unit means is fixedly attached to said moveable carriage means and said support leg means and wherein said carriage means and said support leg means maintain a fixed configuration during rotation with respect to said peripheral support means.

24. The invention of claim 20 wherein said carriage drive means comprises drive cylinder means operably mounted on said carriage means and effectively engageable and disengageable with said support means.

25. The invention of claim 20 wherein said clamping means comprises a clamping cylinder means for displacing opposed end portions of said peripheral support means in a tangential direction whereby the circumference of said peripheral support means is selectively variable.

26. The invention of claim 19 wherein said rotatable cutter wheel means comprise a rotating state in which said cutter wheel means is rotating about said drive shaft means and wherein, during said rotating state, said cutter wheel means comprises a leading portion positioned in the direction of forward circumferential movement and a trailing portion positioned diametrically opposite said forward portion wherein said trailing portion has the cutting surface therein positioned in a substantially vertically spaced apart relationship with the end face of the shaft, the space between said trailing portion and the end face defining a cutting removal space.

27. The invention of claim 19 wherein said rotatable cutter wheel means comprises radially extending paddle means operably mounted thereon for sweeping cuttings cut by said cutter wheel means in a rearwardly direction relative the direction of circumferential advance of said carriage drive means.

28. The invention of claim 19 further comprising a rotatable cover unit means mounted on an upper surface portion of said peripheral support means and rotatable thereon for supporting machine control units, operators, etc., wherein said rotatable cover unit means is fixedly attached to said moveable carriage means and said support leg means and wherein said carriage means and said support leg means maintain a fixed configuration during rotation with respect to said peripheral support means.

29. The invention of claim 19 wherein said carriage means comprises drive cylinder means operably mounted on said carriage means and effectively engageable and disengageable with said support means.

30. The invention of claim 19 wherein said axial shifting drive means comprises:

an axial cylinder operably mounted on said rigid tube means;

an axial piston arm operably associated with said axial cylinder and selectively extendable and retractable parallel to said rigid tube means; said piston arm being operably attached to said drive shaft mounting means.

31. The invention of claim 19 wherein said clamping means comprises a clamping cylinder means for displacing opposed end portions of said peripheral support means in a tangential direction whereby the circumference of said peripheral support means is selectively variable.

32. The invention of claim 16 wherein said drive shaft means comprises a longitudinal axis of rotation which is coaxial with the axis of rotation of said rotatable cutter wheel means wherein said drive shaft means longitudinal axis is inclined relative the axis of the shaft in a plane substantially tangential to the direction of circumferential movement of said movable carriage means.

33. The invention of claim 32 wherein said rotatable cutter wheel means comprise a rotating state in which said cutter wheel means is rotating about said drive shaft means means comprises a leading portion positioned in the direction of forward circumferential movement and a trailing portion positioned diametrically opposite said forward portion wherein said trailing portion has the cutting surface therein positioned in a substantially vertically spaced apart relationship with the end face of the shaft, the space between said trailing portion and the end face defining a cutting removal space.

34. The invention of claim 32 wherein said rotatable cutter wheel means comprises radially extending paddle means operably mounted thereon for sweeping cuttings cut by said cutter wheel means in a rearwardly direction relative the direction of circumferential advance of said carriage drive means.

35. The invention of claim 32 further comprising a rotatable cover unit means mounted on an upper surface portion of said peripheral support means and rotatable thereon for supporting machine control units, operators, etc., wherein said rotatable cover unit means is fixedly attached to said moveable carriage means and said support leg means and wherein said carriage means and said support leg means maintain a fixed configuration during rotation with respect to said peripheral support means.

36. The invention of claim 32 wherein said carriage drive means comprises drive cylinder means operably mounted on said carriage means and effectively engageable and disengageable with said support means.

37. The invention or claim 32 wherein said axial shifting drive means comprises:

an axial cylinder operably mounted on said rigid tube means;

an axial piston arm operably associated with said axial cylinder and selectively extendable and retractable parallel to said rigid tube means; said piston arm being operably attached to said drive shaft mounting means.

38. The invention of claim 32 wherein said clamping means comprises a clamping cylinder means for displacing opposed end portions of said peripheral support means in a tangential direction whereby the circumference of said peripheral support means is selectively variable.

39. The invention of claim 16 wherein said rotatable cutter wheel means comprise a rotating state in which said cutter wheel means is rotating about said drive shaft means and wherein, during said rotating state, said cutter wheel means comprises a leading portion positioned in the direction of forward circumferential movement and a trailing portion positioned diametrically opposite said forward portion wherein said trailing portion has the cutting surface therein positioned in a substantially vertically spaced apart relationship with the end face of the shaft, the space between said trailing portion and the end face defining a cutting removal space.

40. The invention of claim 16 wherein said rotatable cutter wheel means comprises radially extending paddle means operably mounted thereon for sweeping cuttings cut by said cutter wheel means in a rearwardly direction relative the direction of circumferential advance of said carriage drive means.

41. The invention of claim 16 wherein said carriage drive means comprises drive cylinder means operably mounted on said carriage means and effectively engageable and disengageable with said support means.

42. The invention of claim 16 wherein said axial shifting drive means comprises:

an axial cylinder operably mounted on said rigid tube means;

an axial piston arm operably associated with said axial cylinder and selectively extendable and retractable parallel to said rigid tube means; said piston arm being operably attached to said drive shaft mounting means.

43. The invention of claim 16 wherein said clamping means comprises a clamping cylinder means for displacing opposed end portions of said peripheral support means in a tangential direction whereby the circumference of said peripheral support means is selectively variable.

44. The invention as defined in claim 15 and wherein the shaft is substantially vertical and said support means and said carriage means are moved axially downwardly by gravitational force upon release of said clamping means.

45. The invention as defined in claim 15 and wherein said support means and said carriage means comprise concentric arcuate portions.

46. The invention as defined in claim 15 and wherein said tube means and said sleeve means each have a polygonal cross-section throughout at least a portion of the length thereof.

47. The invention as defined in claim 15 and further comprising:

a cuttings conveyor means operatively associated with said cutter wheel means for removing cuttings from the end face of the shaft.

48. The invention as defined in claim 15 wherein said rotatable cutter wheel means shape comprises a substantially cylindrical lateral surface, and a circular base surface wherein cutter devices are operably mounted on said cylindrical lateral surface and on an outer peripheral portion of said circular base surface.

49. The invention of claim 48 wherein said support means and said carriage means comprise concentric arcuate portions.

50. The invention of claim 49 wherein said rotatable cutter wheel means comprise a rotating state in which said cutter wheel means is rotating about said drive shaft means and wherein, during said rotating state, said cutter wheel means comprises a leading portion positioned in the direction of forward circumferential movement and a trailing portion positioned diametrically opposite said forward portion wherein said trailing portion has the cutting surface therein positioned in a substantially vertically spaced apart relationship with the end face of the shaft, the space between said trailing portion and the end face defining a cutting removal space.

51. The invention of claim 49 wherein said rotatable cutter wheel means comprises radially extending paddle means operably mounted thereon for sweeping cuttings cut by said cutter wheel means in a rearwardly direction relative the direction of circumferential advance of said carriage drive means.

52. The invention of claim 49 wherein said carriage drive means comprises drive cylinder means operably mounted on said carriage means and effectively engageable and disengageable with said support means.

53. The invention of claim 49 wherein said axial shifting drive means comprises:

an axial cylinder operably mounted on said rigid tube means;

an axial piston arm operably associated with said axial cylinder and selectively extendable and retractable parallel said rigid tube means; said piston arm being operably attached to said drive shaft mounting means.

54. The invention of claim 49 wherein said clamping means comprises a clamping cylinder means for displacing opposed end portions of said peripheral support means in a tangential direction whereby the circumference of said peripheral support means is selectively variable.

55. The invention of claim 48 wherein said rotatable cutter wheel means comprise a rotating state in which said cutter wheel means is rotating about said drive shaft means and wherein, during said rotating state, said cutter wheel means comprises a leading portion positioned in the direction of forward circumferential movement and a trailing portion positioned diametrically opposite said forward portion wherein said trailing portion has the cutting surface therein positioned in a substantially vertically spaced apart relationship with the end face of the shaft, the space between said trailing end portion and the end face defining a cutting removal space.

56. The invention of claim 48 wherein said rotatable cutter wheel means comprises radially extending paddle means operably mounted thereon for sweeping cuttings cut by said cutter wheel means in a rearwardly direction relative the direction of circumferential advance of said carriage drive means.

57. The invention of claim 48 wherein said carriage drive means comprises drive cylinder means operably mounted on said carriage means and effectively engageable and disengageable with said support means.

58. The invention of claim 48 wherein said axial shifting drive means comprises:

an axial cylinder operably mounted on said rigid tube means;

an axial piston arm operably associated with said axial cylinder and selectively extendable and retractable parallel to said rigid tube means; said piston arm being operably attached to said drive shaft mounting means.

59. The invention of claim 48 wherein said clamping means comprises a clamping cylinder means for displacing end portions of said peripheral support means in a tangential direction whereby the circumference of said peripheral support means is selectively variable.

60. The invention of claim 15 wherein said drive shaft means comprises a longitudinal axis of rotation which is coaxial with the axis of rotation of said rotatable cutter wheel means wherein said drive shaft means longitudinal axis is inclined relative the axis of the shaft in a plane substantially tangential to the direction of circumferential movement of said movable carriage means.

61. The invention as defined by claim 60 wherein said angle of inclination of said drive shaft means is between 5° and 30°.

62. The invention as defined by claim 61 wherein said angle of inclination of said drive shaft means is substantially 15°.

63. The invention as defined by claim 15 wherein said rotatable cutter wheel means comprise a rotating state in which said cutter wheel means is rotating about said drive shaft means and wherein, during said rotating state, said cutter wheel means comprises a leading portion positioned in the direction of forward circumferential movement and a trailing portion positioned diametrically opposite said forward portion wherein said trailing portion has the cutting surface therein positioned in a substantially vertically spaced apart relationship with the end face of the shaft, the space between said trailing portion and the end face defining a cutting removal space.

64. The invention of claim 63 wherein said rotatable cutter wheel means comprises radially extending paddle means operably mounted thereon for sweeping cuttings cut by said cutter wheel means in a rearwardly direction relative the direction of circumferential advance of said carriage drive means.

65. The invention of claim 63 wherein said carriage drive means comprises drive cylinder means operably mounted on said carriage means and effectively engageable and disengageable with said support means.

66. The invention of claim 63 wherein said axial shifting drive means comprises:

an axial cylinder operably mounted on said rigid tube means;

an axial piston arm operably associated with said axial cylinder and selectively extendable and retractable parallel to said rigid tube means; said piston arm being operably attached to said drive shaft mounting means.

67. The invention of claim 63 wherein said clamping means comprises a clamping cylinder means for displacing opposed end portions of said peripheral support means in a tangential direction whereby the circumference of said peripheral support means is selectively variable.

68. The invention as defined by claim 63 further comprising:

a cutting conveyor means operably associated with said cutter wheel means for removing cuttings from the end face of the shaft.

69. The invention as defined by claim 68 wherein said cutting conveyor means comprises a horizontal conveyor means having a first, end and a second end wherein said first end is positioned in said cutting removal space beneath said trailing edge and wherein said second end is positioned in spaced apart noninterfering relationship with said cutter wheel means wherein the direction of conveyance of said horizontal cutting means is from said first end to said second end.

70. The invention as defined by claim 69 wherein said cutting conveyor means further comprises:

vertical conveyor means operably associated with said second end of said horizontal conveyor means for receiving cuttings therefrom and conveying the cuttings to an elevated position above said peripheral support means for subsequent removal.

71. The invention of claim 60 wherein said rotatable cutter wheel means comprise a rotating state in which said cutter wheel means is rotating about said drive shaft means and wherein, during said rotating state, said cutter wheel means comprises a leading portion positioned in the direction of forward circumferential movement and a trailing portion positioned diametrically opposite said forward portion wherein said trailing portion has the cutting surface therein positioned in a substantially vertically spaced apart relationship with the end face of the shaft, the space between said trailing portion and the end face defining a cutting removal space.

72. The invention of claims 39, 55, 71, 64, 65, 66, 67, 33, 50 or 21 further comprising:

a cutting conveyor means operably associated with said cutter wheel means for removing cuttings from the end face of the shaft.

73. The invention of claim 72 wherein said cutting means comprises a horizontal conveyor means having a first, end and a second end wherein said first end is positioned in said cutting removal space beneath said trailing edge and wherein said second end is positioned in spaced apart noninterfering relationship with said cutter wheel means wherein the direction of conveyance of said horizontal cutting means is from said first end to said second end.

74. The invention of claim 73 wherein said cutting conveyor means further comprises:

vertical conveyor means operably associated with said second end of said horizontal conveyor means for receiving cuttings therefrom and conveying the cuttings to an elevated position above said peripheral support means for subsequent removal.

75. The invention of claim 60 wherein said rotatable cutter wheel means comprises radially extending paddle means operably mounted thereon for sweeping cuttings cut by said cutter wheel means in a rearwardly direction relative the direction of circumferential advance of said carriage drive means.

76. The invention of claim 60 wherein said carriage drive means comprises drive cylinder means operably mounted on said carriage means and effectively engageable and disengageable with said support means.

77. The invention of claim 60 wherein said axial shifting drive means comprises:

an axial cylinder operably mounted on said rigid tube means;

an axial piston arm operably associated with said axial cylinder and selectively extendable and retractable parallel to said rigid tube means; said piston arm being operably attached to said drive shaft mounting means.

78. The invention of claim 60 wherein said clamping means comprises a clamping cylinder means for displacing means comprises a clamping cylinder means for displacing opposed end portions of said peripheral support means in a tangential direction whereby the circumference of said peripheral support means is selectively variable.

79. The inventions of claims 32, 49, 71, 75, 76, 77, 78, 20, 33, 34, 35, 36, 38, 50, 51, 52, 53, 54, 21, 22, 23, 24, or 25 wherein said angle of inclination of said drive shaft means is between 5° and 30°.

80. The invention as defined by claim 3 wherein said rotatable cutter wheel means comprises radially extending paddle means operably mounted thereon for sweeping cuttings cut by said cutter wheel means in a rearwardly direction relative the direction of circumferential advance of said carriage drive means.

81. The invention of claim 80 wherein said carriage drive means comprises drive cylinder means operably mounted on said carriage means and effectively engageable and disengageable with said support means.

82. The invention of claim 80 wherein said axial shifting drive means comprises:

an axial cylinder operably mounted on said rigid tube means;

an axial piston arm operably associated with said axial cylinder and selectively extendable and retractable parallel to said rigid tube means; said piston arm being operably attached to said drive shaft mounting means.

83. The invention of claim 80 wherein said rotatable cutter wheel means shape comprises a substantially cylindrical lateral surface, and a circular base surface and wherein cutter devices are operably mounted on said cylindrical lateral surface on an outer peripheral portion of said circular base surface.

84. The invention of claims 80, 40, 56, 75, 64, 81, 82, 83, 27, 34, 51, or 22 further comprising ramp and shield mans for facilitating the movement of rock cuttings by said paddle means.

85. The invention as defined by claim 15 wherein said carriage drive means comprises drive cyinder means operably mounted on said carriage means and effectively engageable and disengageable with said support means.

86. The invention as defined by claim 85 wherein said drive cylinder means comprise:

a first drive cylinder pivotally mounted on said carriage means and pivotal about a first drive cylinder axis which is substantially parallel to the axis of said support means;

a second drive cylinder pivotally mounted on said carriage means in spaced apart relationship with said first drive cylinder and pivotal about a second drive cylinder axis which is substantially coaxial with said first drive cylinder axis;

a first piston arm operably associated with said first drive cylinder;

a second piston arm operably associated with said second cylinder;

first shoe means pivotally mounted on said first piston arm distal said first drive cylinder for engaging first slot means in said support means;

second shoe means pivotally mounted on said second piston arm distal said second drive cylinder for engaging second slot means in said support means;

first slot means positioned in said support means in coplanar relationship with the plane of rotation of said first drive cylinder about said first drive cylinder axis for receiving portion of said first shoe means in drivingly abutting engagement; and second slot means positioned in said support means in coplanar relationship with the plane of rotation of said second drive cylinder about said second drive cylinder axis for receiving portions of said second shoe means in drivingly abutting engagement.

87. The invention as defined by claim 86 further comprising drive cylinder rotation means for selectively rotating said first and second drive cylinder about said first and second drive cylinder axes whereby said first and second shoe means may be advanced from slot to slot in said first and second slot means.

88. The invention of claim 85 wherein said axial shifting drive means comprises:

an axial cylinder operably mounted on said rigid tube means;

an axial piston arm operably associated with said axial cylinder and selectively extendable and retractable parallel to said rigid tube means; said piston arm being operably attached to said drive shaft mounting means.

89. The invention of claim 85 wherein said clamping means comprises a clamping cylinder means for displacing opposed end portions of said peripheral support means in a tangential direction whereby the circumference of said peripheral support means is selectively variable.

90. The invention of claims 41, 57, 76, 65, 81, 88, 89, 29, 36, 52, or 24 wherein said drive cylinder means comprise:

a first drive cylinder pivotally mounted on said carriage means and pivotal about a first drive cylinder axis which is substantially parallel to the axis of said support means;

a second drive cylinder pivotally mounted on said carriage means in spaced apart relationship with said first drive cylinder and pivotal about a second drive cylinder which is substantially coaxial with said first drive cylinder axis;

first piston arm operably associated with said first drive cylinder;

a second piston arm operably associated with said second cylinder;

first shoe means pivotally mounted on said first piston arm distal said first drive cylinder for engaging first slot means in said support means;

second shoe means pivotally mounted on said second piston arm distal said second drive cylinder for engaging second slot means in said support means;

first slot means positioned in said support means in coplanar relationship with the plane of rotation of said first drive cyulinder about said first drive cylinder axis for receiving portion of said first shoe means in drivingly abutting engagement; and second slot means positioned in said support means in coplanar relationship with the plane of rotation of said second drive cylinder about said second drive cylinder axis for receiving portions of said second shoe means in drivingly abutting engagement.

91. The invention as defined by claim 15 wherein said axial shifting drive means comprises:

an axial cylinder operably mounted on said rigid tube means;

an axial piston arm operably associated with said axial cylinder and selectively extendible and retractable parallel to said rigid tube means; said piston arm being operably attached to said drive shaft mounting means.

92. The invention of claim 9 wherein said clamping means comprises a clamping cylinder means for displacing opposed end portions of said peripheral support means in a tangential direction whereby the circumference of said peripheral support means is selectively variable.

93. The invention as defined by claim 91 wherein said rotatable cutter wheel means shape comprises a substantially cylindrical lateral surface, and a circular base surface and wherein cutter devices are operably mounted on said cylindrical lateral surface on an outer peripheral portion of said circular base surface.

94. The invention as defined by claim 93 wherein said drive shaft means comprises a longitudinal axis of rotation which is coaxial with the axis of rotation of said rotatable cutter wheel means wherein said drive shaft means longitudinal axis is inclined relative the axis of the shaft in a plane substantially tangential to the direction of circumferential movement of said movable carriage means.

95. The invention as defined by claim 94 wherein said angle of inclination of said drive shaft means is substantially 15°.

96. The invention as defined by claim 15 wherein said clamping means comprises a clamping cylinder means for displacing opposed end portions of said peripheral support means in a tangential direction whereby the circumference of said peripheral support means is selectively variable.

* * * * *